US012523235B2

(12) United States Patent
Dern

(10) Patent No.: US 12,523,235 B2
(45) Date of Patent: Jan. 13, 2026

(54) CENTRIFUGAL PUMP IMPELLER WITH TAPERED SHROUD

(71) Applicant: Weir Minerals Australia Ltd, Artarmon (AU)

(72) Inventor: Michael George Dern, Lane Cove (AU)

(73) Assignee: Weir Minerals Australia Ltd (AU)

( * ) Notice: Subject to any disclaimer, the term of this patent is extended or adjusted under 35 U.S.C. 154(b) by 0 days.

(21) Appl. No.: 18/565,720

(22) PCT Filed: Jun. 25, 2022

(86) PCT No.: PCT/AU2022/050655
§ 371 (c)(1),
(2) Date: Nov. 30, 2023

(87) PCT Pub. No.: WO2022/266725
PCT Pub. Date: Dec. 29, 2022

(65) Prior Publication Data

US 2024/0255000 A1 Aug. 1, 2024

(30) Foreign Application Priority Data

Jun. 25, 2021 (AU) ..... 2021901940

(51) Int. Cl.

| | |
|---|---|
| ***F04D 29/22*** | (2006.01) |
| ***F04D 1/00*** | (2006.01) |
| ***F04D 7/04*** | (2006.01) |
| ***F04D 29/24*** | (2006.01) |

(52) U.S. Cl.
CPC ..... *F04D 29/2216* (2013.01); *F04D 1/00* (2013.01); *F04D 7/04* (2013.01); *F04D 29/24* (2013.01)

(58) Field of Classification Search
CPC ... F04D 1/00; F04D 7/04; F04D 7/045; F04D 29/22–2294; F04D 29/28–305
See application file for complete search history.

(56) References Cited

U.S. PATENT DOCUMENTS 3,205,828 A * 9/1965 Rupp ..... F04D 29/2205 415/206
6,123,507 A * 9/2000 Weis ..... F04D 29/225 416/144
7,153,097 B2 * 12/2006 Kawabata ..... F04D 29/2216 415/206

(Continued)

FOREIGN PATENT DOCUMENTS

WO 2019071318 A1 4/2019
WO 2020058081 A1 3/2020

*Primary Examiner* — Christopher R Legendre
(74) *Attorney, Agent, or Firm* — MORRISS O'BRYANT COMPAGNI CANNON, PLLC

(57) ABSTRACT

An impeller for a centrifugal pump has an inlet through which fluid passes into the impeller as well as pumping vanes for pumping the fluid from the inlet and expelling the fluid into a pumping chamber of the centrifugal pump in which the impeller operates, and the impeller also has at least one shroud extending radially from an axis of rotation for the impeller and attached to the pumping vanes, the at least one shroud having a planar portion located towards a center of the impeller and a tapered portion located towards an outer edge of the shroud, the tapered portion being a compound shape and having a concave and a convex region.

7 Claims, 18 Drawing Sheets

(56) References Cited

U.S. PATENT DOCUMENTS

| | | | | |
|---|---|---|---|---|
| 8,469,669 | B2 * | 6/2013 | Ressing | F04D 29/284 416/189 |
| 8,608,445 | B2 * | 12/2013 | Burgess | F04D 7/04 416/DIG. 2 |
| 11,493,054 | B2 * | 11/2022 | Yagi | F01D 5/043 |
| 2007/0274820 | A1 | 11/2007 | Lindskog | |
| 2016/0061213 | A1 | 3/2016 | Lavagna et al. | |
| 2024/0255000 | A1 * | 8/2024 | Dern | F04D 29/2294 |

* cited by examiner

48

CENTRIFUGAL PUMP IMPELLER WITH TAPERED SHROUD

TECHNICAL FIELD

The present invention generally relates to the field of centrifugal pumps. More particularly, the present invention relates to an improved impeller for a centrifugal pump.

BACKGROUND

One form of centrifugal slurry pumps generally comprises an outer pump casing which encases a liner. The liner has a pumping chamber therein which may be of a volute, semi volute or concentric configuration, and is arranged to receive an impeller which is mounted for rotation within the pumping chamber. A drive shaft is operatively connected to the pump impeller for causing rotation thereof, the drive shaft entering the pump casing from one side. The pump further includes a pump inlet which is typically coaxial with respect to the drive shaft and located on the opposite side of the pump casing to the drive shaft. There is also a discharge outlet typically located at a periphery of the pump casing. The liner includes a main liner (sometimes referred to as the volute) and front and back side liners which are encased within the outer pump casing. The front side liner is often referred to as the front liner suction plate or throatbush. The back side liner is often referred to as the frame plate liner insert.

The impeller typically includes a hub to which the drive shaft is operatively connected, and at least one shroud. Pumping vanes are provided on one side of the shroud with discharge passageways between adjacent pumping vanes. The impeller may be of the closed type where two shrouds are provided with the pumping vanes being disposed therebetween. The shrouds are often referred to as the front shroud adjacent the pump inlet and the back shroud. The impeller may also be of the open face type which comprises one shroud only.

One of the major wear areas in the slurry pump is the front and back side liners. Slurry enters the impeller in the centre or eye and is then flung out to the periphery of the impeller and into the pump casing. Because there is a pressure difference between the casing and the eye, there is a tendency for the slurry to try and migrate into a gap which is between the side liners and the impeller, resulting in high wear on the side liners.

As the slurry pump operates, the slurry is energized by rotary motion of the impeller. The slurry flows centrifugally and is collected by the main liner which directs the slurry towards the discharge outlet. Due to the main liner shape, the cut water area influences the flow pattern of recirculating slurry passing by. The side liners are in contact with the slurry within the cavity of the impeller shrouds. The proximity of the impeller outer shroud, or expeller vanes typical in the case of centrifugal slurry pumps, and the main liner cutwater to the frame plate liner may influence erosion rates endured by the side liners. In mill circuit duties, which are typically operated at low flow, erosion rates on the side liners is increased due to the increased rates of internal recirculation, which lead to the side liner eventually being a component with a short life span due to localized wear, sometimes referred to as "gouging".

In order to try and reduce wear in the region of the gap, it has been the practice for slurry pumps to have auxiliary or expelling vanes on the front shroud of the impeller. Auxiliary or expelling vanes may also be provided on the back shroud. The expelling vanes rotate the slurry in the gap creating a centrifugal field and thus reducing the driving pressure for the returning flow, reducing the flow velocity and thus the wear on the side liner. The purpose of these auxiliary vanes is to reduce flow re-circulation through the gap. These auxiliary vanes also reduce the influx of relatively large solid particles in this gap.

The reference in this specification to any prior publication (or information derived from the prior publication), or to any matter which is known, is not, and should not be taken as an acknowledgment or admission or any form of suggestion that the prior publication (or information derived from the prior publication) or known matter forms part of the common general knowledge in the field of endeavour to which this specification relates.

SUMMARY

One embodiment describes an impeller for a centrifugal pump, the impeller comprising: an inlet through which fluid passes into the impeller; pumping vanes for pumping the fluid from the inlet and expelling the fluid into a pumping chamber of the centrifugal pump in which the impeller operates; and at least one shroud extending radially from an axis of rotation for the impeller and attached to the pumping vanes, the at least one shroud having a planar portion located towards a centre of the impeller and a tapered portion located towards an outer edge of the shroud, the tapered portion being a compound shape and having a concave and a convex region.

In one embodiment the tapered portion of the at least one shroud has a thickness variation greater than outside the tapered portion.

In one embodiment the tapered portion reduces thickness of the at least one shroud on an outer face of the shroud.

In one embodiment the at least one shroud has auxiliary vanes.

In one embodiment the auxiliary vanes extend into the tapered portion.

In one embodiment the auxiliary vanes are tapered in the tapered portion.

In one embodiment the auxiliary vanes are absent in the tapered portion.

In one embodiment the convex region is located closer to the outer edge than the concave region.

In one embodiment a thickness of the at least one shroud decreased by at least half in the tapered portion.

In one embodiment the planar portion of the at least one shroud has a variable thickness.

In one embodiment the planar portion of the at least one shroud is thinner near the outer edge than near the centre of the impeller.

In one embodiment the at least one shroud is two shrouds located on either side of the pumping vanes and the fluid is pumped between the two shrouds.

In one embodiment, each of the two shrouds have a tapered portion.

One embodiment discloses a pump having an impeller an impeller, the impeller comprising: an inlet through which fluid passes into the impeller; pumping vanes for pumping the fluid from the inlet and expelling the fluid into a pumping chamber of the centrifugal pump in which the impeller operates; and at least one shroud extending radially from an axis of rotation for the impeller and attached to the pumping vanes, the at least one shroud having a planar portion located towards a centre of the impeller and a tapered portion located towards an outer edge of the shroud.

In one embodiment the pump has a patterned side liner.

In one embodiment the patterned side liner is selected from the set of side liner comprising a front side liner and a back side liner.

In one embodiment the patterned side liner is a grooved side liner.

In one embodiment the patterned side liner is has a radially swirling pattern.

BRIEF DESCRIPTION OF FIGURES

Example embodiments are provided in the following description, which is given by way of example only, of at least one preferred but non-limiting embodiment, described in connection with the accompanying figures.

DETAILED DESCRIPTION

The following modes, given by way of example only, are described in order to provide a more precise understanding of the subject matter of a preferred embodiment or embodiments.

Example Impeller

Described is an impeller for a centrifugal pump having shrouds that are tapered at one end of the shroud. Each shroud of the impeller has a tapered region, located near an outer edge of the shroud. The tapered region reduces a thickness of the shrouds, with the shrouds getting thinner towards the outer edge of the shrouds. The tapered portion may be a compound shape and having a concave and a convex region. The tapered portion may reduce wear of a liner of the pump, when the pump has a patterned side liner, compared to a pump using a flat side liner.

The impeller for a centrifugal pump has an inlet through which fluid passes into the impeller. The impeller has pumping vanes for pumping the fluid from the inlet and expelling the fluid into a pumping chamber of the centrifugal pump in which the impeller operates. The impeller also has one or more shrouds extending radially from an axis of rotation for the impeller and attached to the pumping vanes. The one or more shrouds have a planar portion located towards a centre of the impeller and a tapered portion located towards an outer edge of the shroud.

Figure 1:
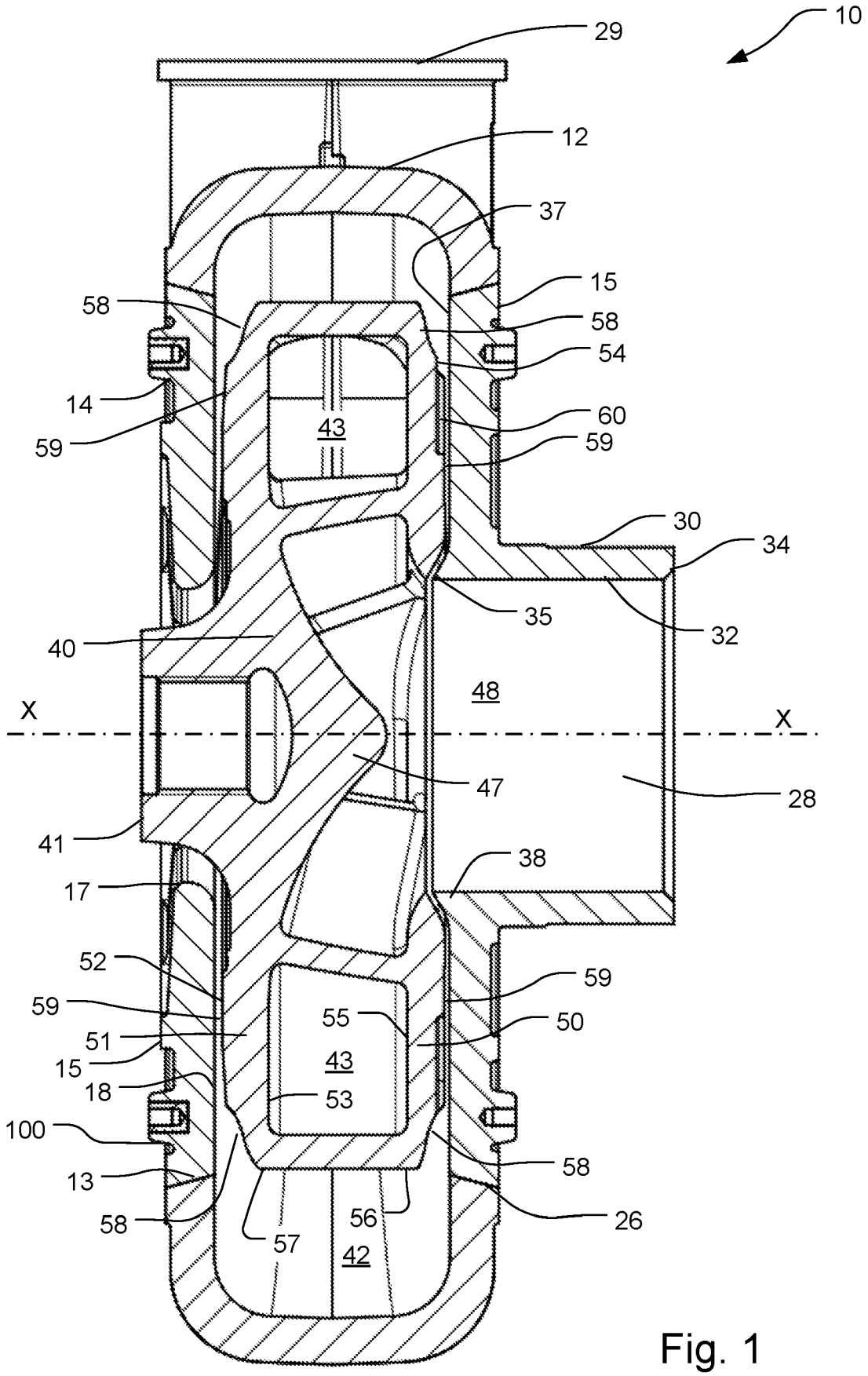
FIG. 1 is a schematic partial cross-sectional side elevation of one form of a centrifugal pump apparatus according to one embodiment.
Figure 2:
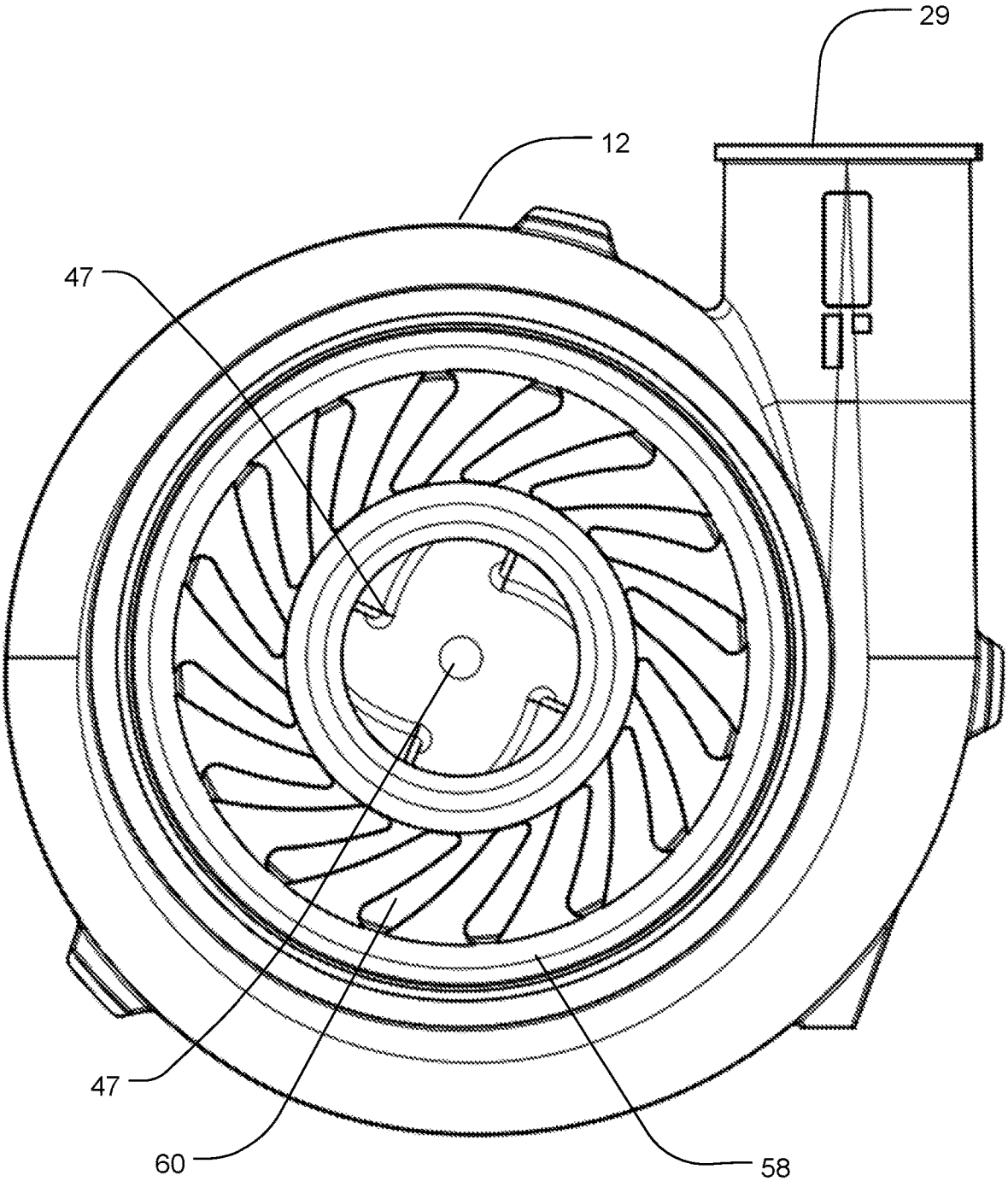
FIG. 2 is a side view of the pump of FIG. 1.
Figure 3:
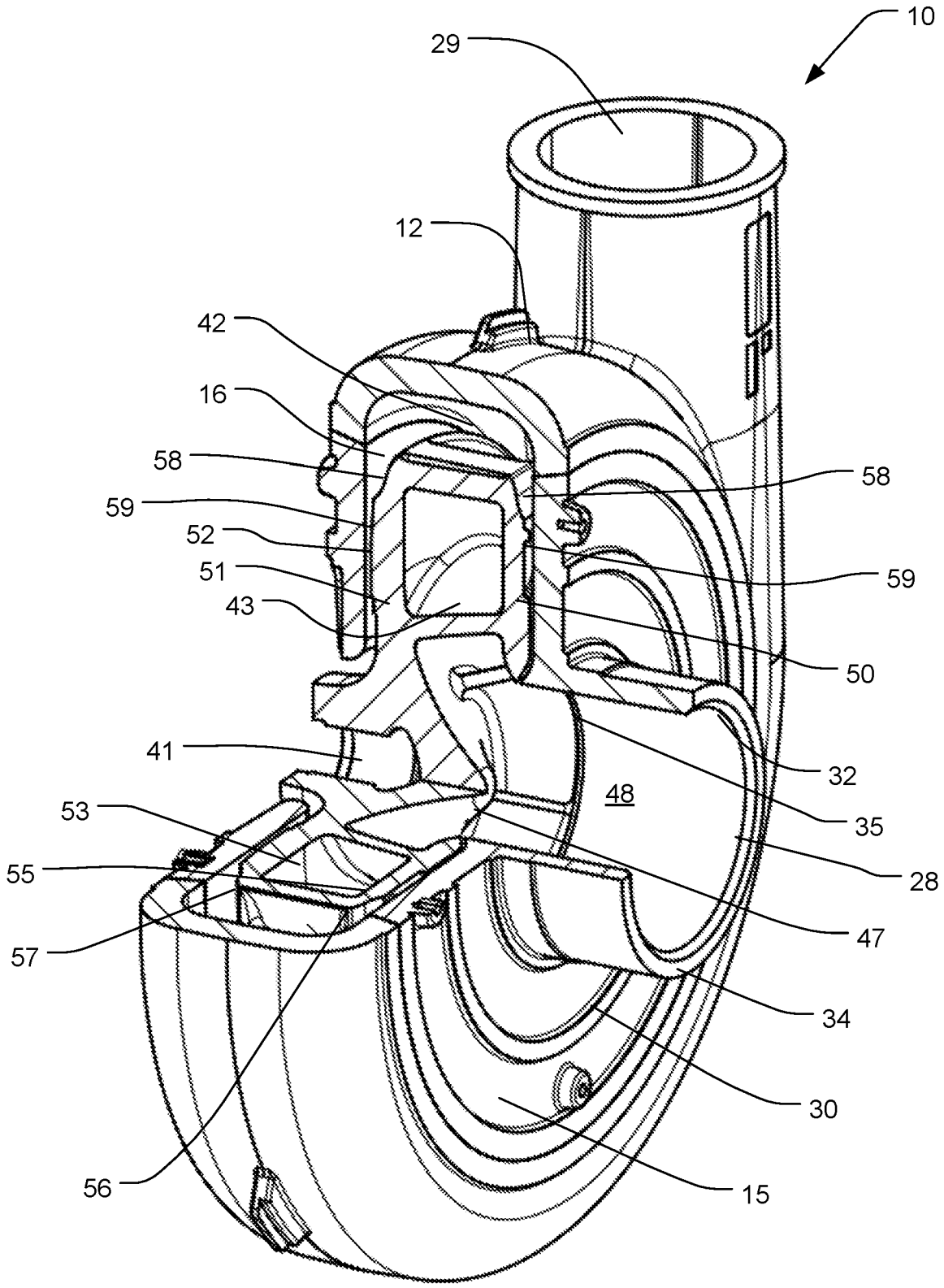
FIG. 3 is an isometric view, with a cut out, of the pump of FIG. 1.

Referring to FIGS. 1, 2 and 3 of the drawings, there is generally illustrated a pump apparatus comprising a pump 10 and pump housing support in the form of a pedestal or base, not shown, to which the pump 10 is mounted. Pedestals are also referred to in the pump industry as frames. The pump 10 generally comprises an outer casing that is formed from two side casing parts or sections (sometimes also known as the frame plate and the cover plate) which are joined together about the periphery of the two side casing sections. The pump 10 is formed with side openings one of which is an inlet hole 28 there further being a discharge outlet hole 29 and, when in use in a process plant, the pump is connected by piping to the inlet hole 28 and to the outlet hole 29, for example to facilitate pumping of a mineral slurry.

The pump 10 further comprises a pump inner liner arranged within the outer casing and which includes a main liner 12 and two side liners 14, 30. The side liner 14 is located nearer the rear end of the pump 10 (that is, nearest to the pedestal or base), and the other side liner (or front liner) 30 is located nearer the front end of the pump and inlet hole 28. The side liner 14 is also referred to as the back side part or frame plate liner insert and the side liner 30 is also referred to as the front side part or throatbush. The main liner comprises two side openings therein. As shown in FIG. 1 the back side liner 14 comprises a disc like main body 100 having an inner edge 17 and an outer edge 13. The main body 100 has a first side 15 and a second side 18.

In some embodiments the main liner 12 can be comprised of two separate parts which are assembled within each of the side casing parts and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing. A seal chamber housing encloses the side liner (or back side part) 14 and is arranged to seal the space or chamber between drive shaft and the pedestal or base to prevent leakage from the back area of the outer casing. The seal chamber housing takes the form of a circular disc section and an annular section with a central bore, and is known in one arrangement as a stuffing box (not shown). The stuffing box is arranged adjacent to the side liner 14 and extends between the pedestal and a shaft sleeve and packing that surrounds drive shaft.

As shown in FIGS. 1, 2 and 3, an impeller 40 is positioned within the main liner 12 and is mounted or operatively connected to the drive shaft which is adapted to rotate about a rotation axis X-X. A motor drive (not shown) is normally attached by pulleys to an exposed end of the shaft, in the region behind the pedestal or base. The rotation of the impeller 40 causes the fluid (or solid-liquid mixture) being pumped to pass from a pipe which is connected to the inlet hole through the pumping chamber 42 which is within the main liner 12 and the side liners 14, 30 and then out of the pump via the discharge outlet hole.

The impeller 40 includes a hub 41 from which a plurality of circumferentially spaced pumping vanes 43 extend. A central nose portion 47 extends forwardly from the hub 41 towards a passage in the front liner 30. The impeller 40 further includes a front shroud 50 and a back shroud 51, the vanes 43 being disposed and extending therebetween and an impeller inlet 48. The hub 41 extends through a hole, formed by the inner edge 17 of the back liner 14. The front shroud 50 and the back shroud 51 extend radially from an axis of rotation, rotation axis X-X, of the impeller 40 and are attached to the pumping vanes 43. The front shroud 50 and the back shroud 51 are two shrouds located on either side of the pumping vanes 43 with a slurry being pumped between the two shrouds.

The impeller front shroud 50 includes an inner face 55, an outer face 54 and a peripheral edge portion 56, also referred to as an outer edge. The back shroud 51 includes an inner face 53, an outer face 52 and a peripheral edge portion, or outer edge 57. The front shroud 50 includes the inlet 48, being the impeller inlet and the vanes 43 extend between the inner faces of the shrouds 50, 51. The shrouds are generally circular or disc-shaped when viewed in elevation; that is in the direction of rotation axis X-X.

Also shown on the front shroud 50 and the back shroud 51 are shroud tapers 58. The shroud tapers 58 are located on the outer face 52 of the back shroud 51 and the outer face 54 of the front shroud 50. Each of the shroud tapers 58 is a tapered portion of the shroud where thickness of the shroud is reduced. As shown, the reduction in thickness of the shroud at the tapered portion occurs on the outer surface of the shroud. In some embodiments the thickness of the shroud may be reduced for the outer and inner portions of the shroud. The shroud tapers 58 are located closer to the peripheral edge portion 56 and the peripheral edge portion 57, also referred to as the outer edge of the shrouds. The shroud tapers 58 are located near planar portions 59 of the outer faces 52, 54. The planar portions 59 are located closer to, or towards, a centre of impeller 40 while the shroud tapers 58 are located closer to, or up to, the outer edge of the impeller 40.

For the impeller 40, the thickness of the front shroud 50 and the back shroud 51 varies to more in the shroud tapers 58 than for other portions of the shrouds 50, 51 such as the planar portions 59. For some impellers, the shroud tapers 58 may reduce, or vary, the thickness of the shroud by at least half in the tapered portion. That is, the thickness at the thicker end of the shroud tapers 58 is at least twice the thickness of the shroud tapers 58 at the thinner end. For some impellers the thickness reduction of the shroud tapers 58 may be approximately 25%, 30%, 35%, 40%, 45%, 50%, 55%, 60%, 65%, 70%, 75%, 80% or 85%. For example, if the shroud thickness is 100 mm at the start of the tapered portion, the thickness at the outer edge may be 75 mm for a 25% reduction.

Each impeller shroud may have a plurality of auxiliary or expelling vanes 60 on the outer faces 52, 54 thereof. A shape of the auxiliary vanes may also be subject to the shroud tapers 58 with the end of the auxiliary vanes, located near an outer edge of the shrouds, conforming to the shaped of the shroud tapers 58. Auxiliary vanes are an optional feature of the impeller.

The front side liner 30 has a cylindrically shaped inlet section 32 leading from an outermost end 34 to an innermost end 35. When the pump 10 is in operation, the outermost end 34 may be connected to a feed pipe, not shown, through which slurry is fed to the pump 10. The innermost end 35 has a raised lip 38 which is arranged in a close facing relationship with the impeller 40 when in an assembled position. The front side liner 30 has a surface 37, facing in towards the pumping chamber 42, which is in contact with the pump 10 during pump operation as well as an outer edge 26.

Figure 4A:
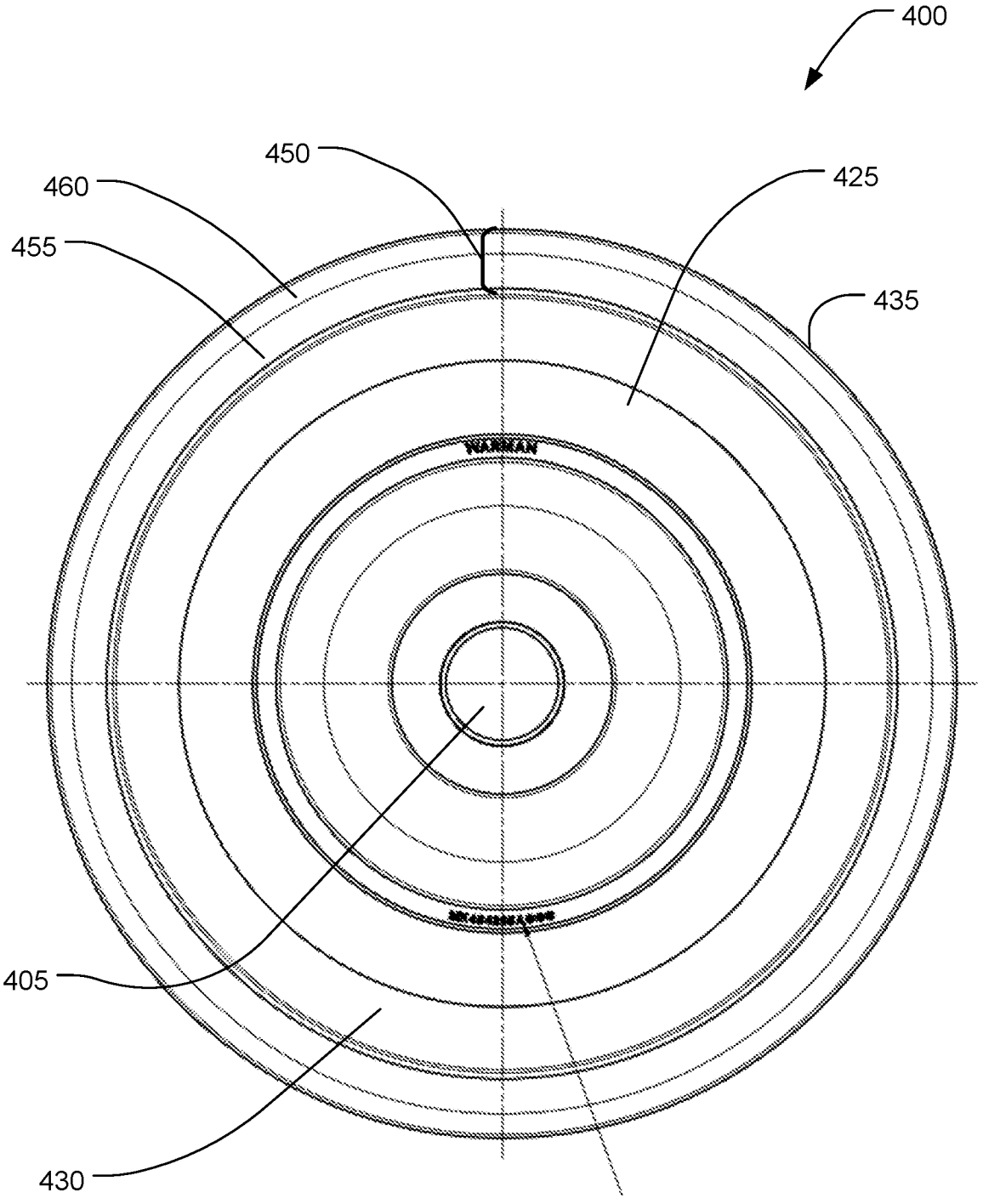
FIGS. 4A to 4D are views of an impeller that may be used in the centrifugal pump of FIG. 1.
Figure 4B:
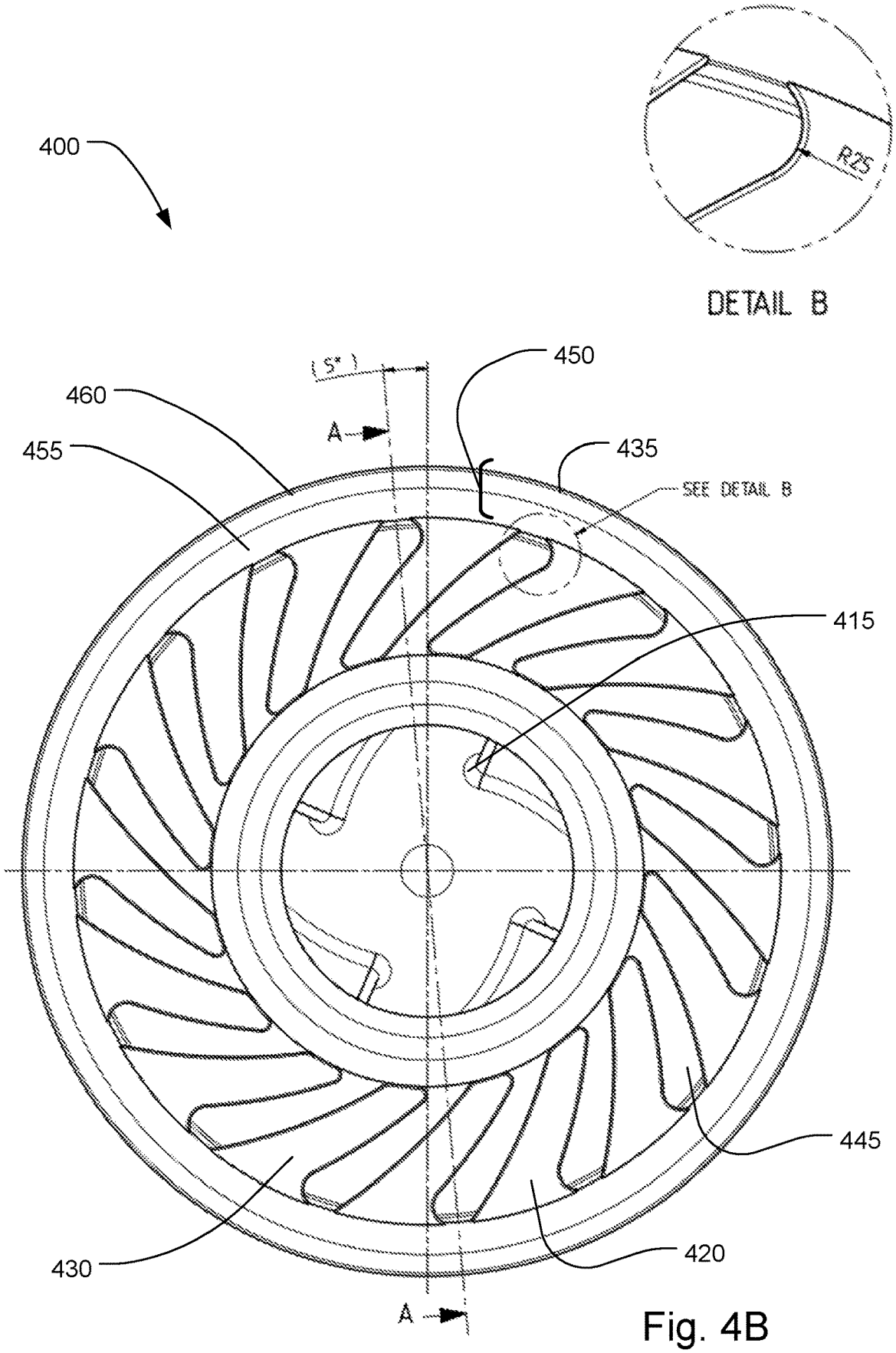
Figure 4C:
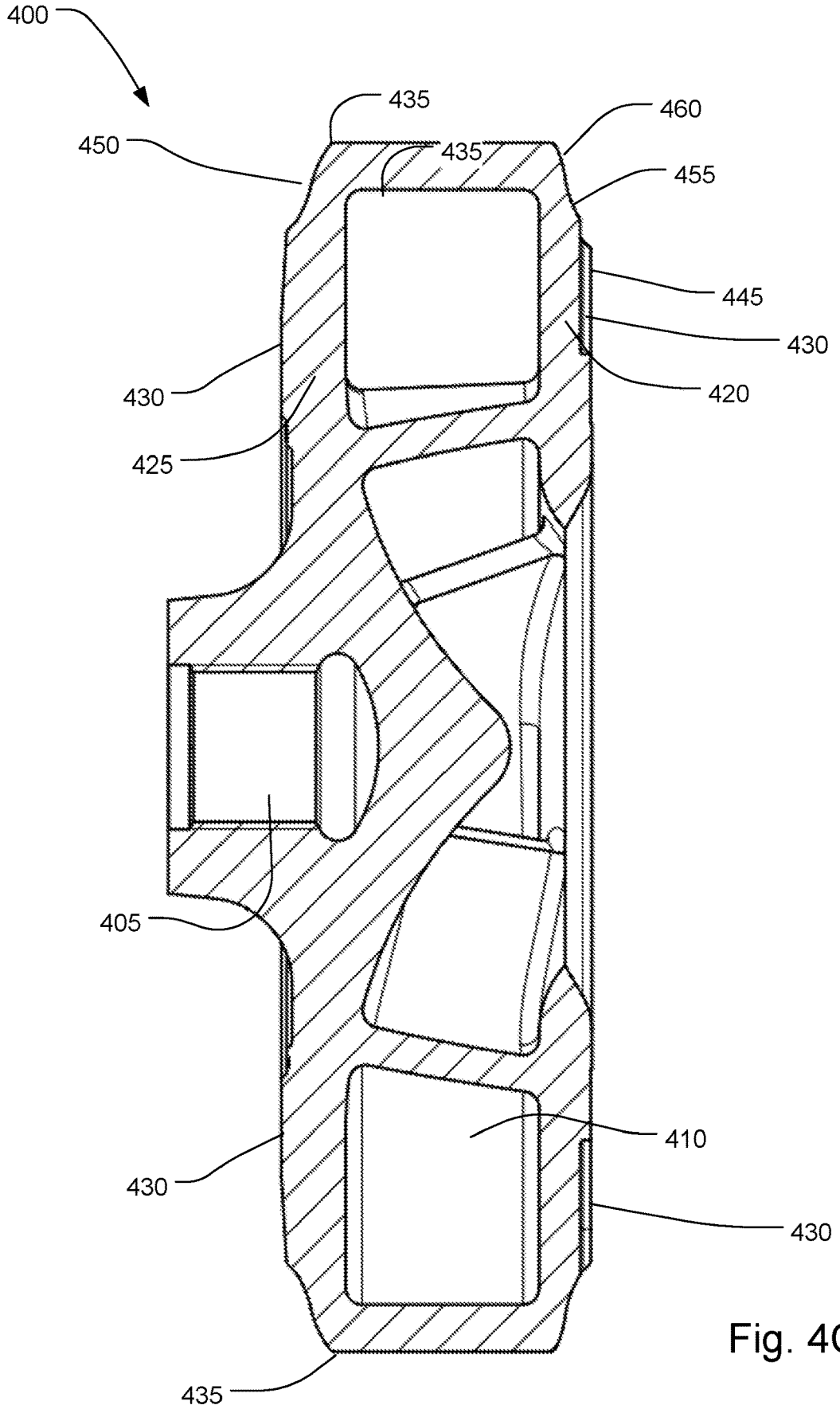
Figure 4D:
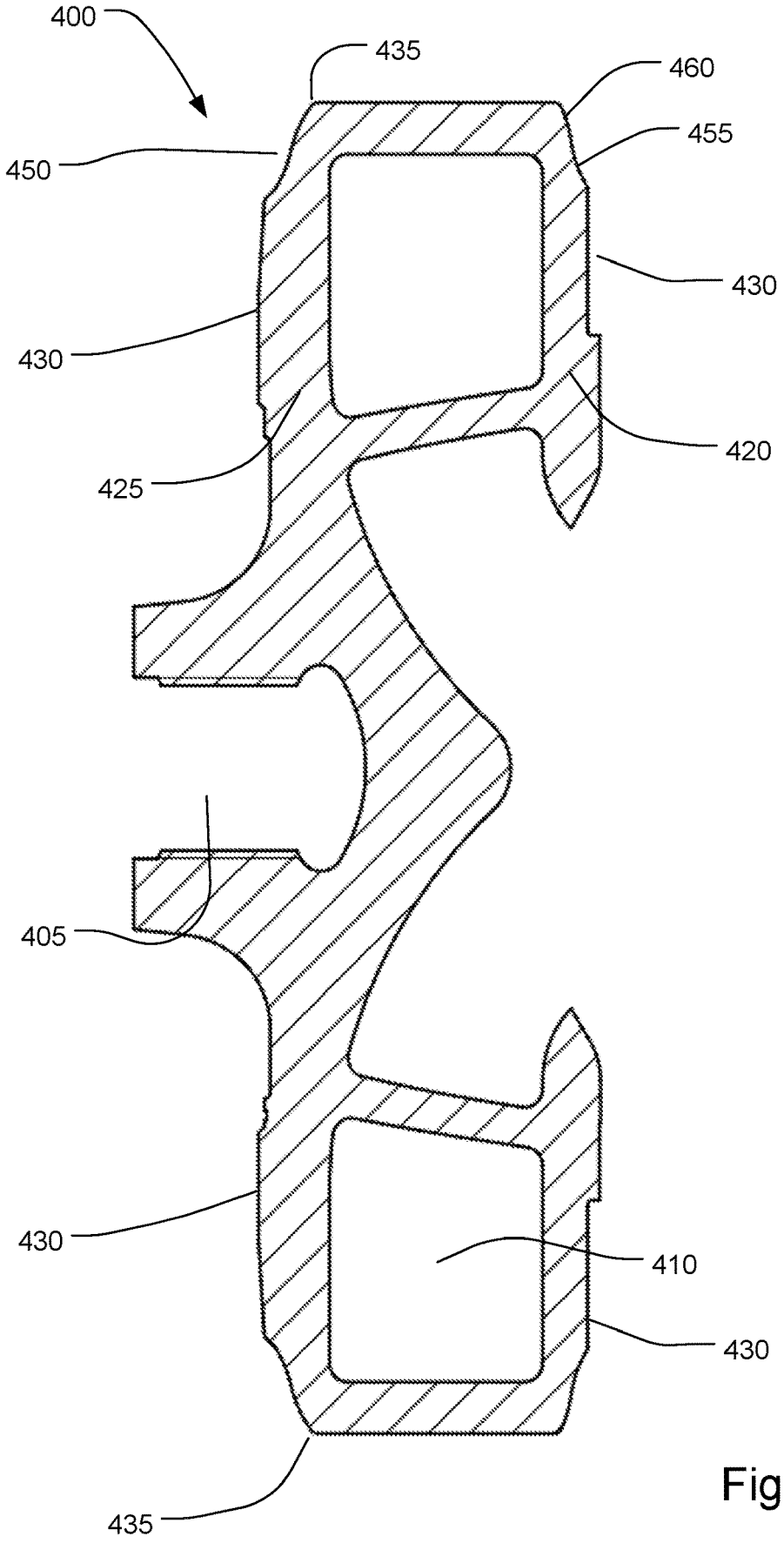

An impeller 400, as may be used in pump 10, will now be described with reference to FIGS. 4A to D. The figures show the impeller 400 with FIG. 4A showing a view of a back shroud 425, FIG. 4B showing a view of a front shroud 420, FIG. 4C showing a cross section through the impeller 400 and FIG. 4D showing a slice through the impeller 400.

The pump inlet is coaxial with respect to a drive shaft and is located on the opposite side of the pump casing to the drive shaft. The drive shaft attaches to the impeller 400 through a hub 405. The impeller 400 has circumferentially spaced pumping vanes 410 with a leading edge 415. The circumferentially spaced pumping vanes 410 take slurry from an inlet, such as the cylindrically inlet section 32 of pump 10, of a centrifugal pump.

Located on an outer face of the front shroud 420 are auxiliary vanes 445. The auxiliary vanes 445 are located on a front side surface of the impeller 400, the front side surface being the surface closest to a front side liner of the pump. The circumferentially spaced pumping vanes 410 are normally referred to as backwards-curving vanes when viewed with a direction of rotation of the impeller 400. The auxiliary vanes 445 are also curved and are shown with curvature in the same direction as the circumferentially spaced pumping vanes 410.

The auxiliary vanes 445 may assist in pumping slurry in a centrifugal pump. The auxiliary vanes may work in conjunction with other vanes, such as circumferentially spaced pumping vanes 410 of impeller 400 to move slurry from the inlet of the centrifugal pump to an outlet. In one embodiment, the back shroud 425 may also have auxiliary vanes.

Each shroud of the impeller 400 has a tapered portion 450 located at an outer edge 435 of the shroud. The tapered portion 450 is a region of the impeller 400 where a thickness of the impeller 400 is reduced. As shown in FIG. 4C, the tapered portion 450 has a concave region of taper 455, located closer to the axis of rotation of the impeller 400, and a convex region of taper 460 located at an edge of the shrouds. The two concave regions may have different radius of curvature or even varying curvature within a region. For example, the concave region of taper 455 and/or the convex region of taper 460 may have a varying radius of curvature.

The thickness of the front shroud 420 and the back shroud 425 is approximately halved for the impeller 400 with the reduction in the thickness occurring only from the outside face of the shrouds. Each shroud of the impeller 400 also has a planar portion 430 located on the outer face and located between the tapered portion 450 and a centre of the impeller 400. The planar portion 430 includes the region of the impeller 400 where the auxiliary vanes 445 are located. The planar portion 430 may be a region where thickness of the front shroud 420 and the back shroud 425 may also decrease, but at a slow rate than the tapered portion 450.

Figure 5A:
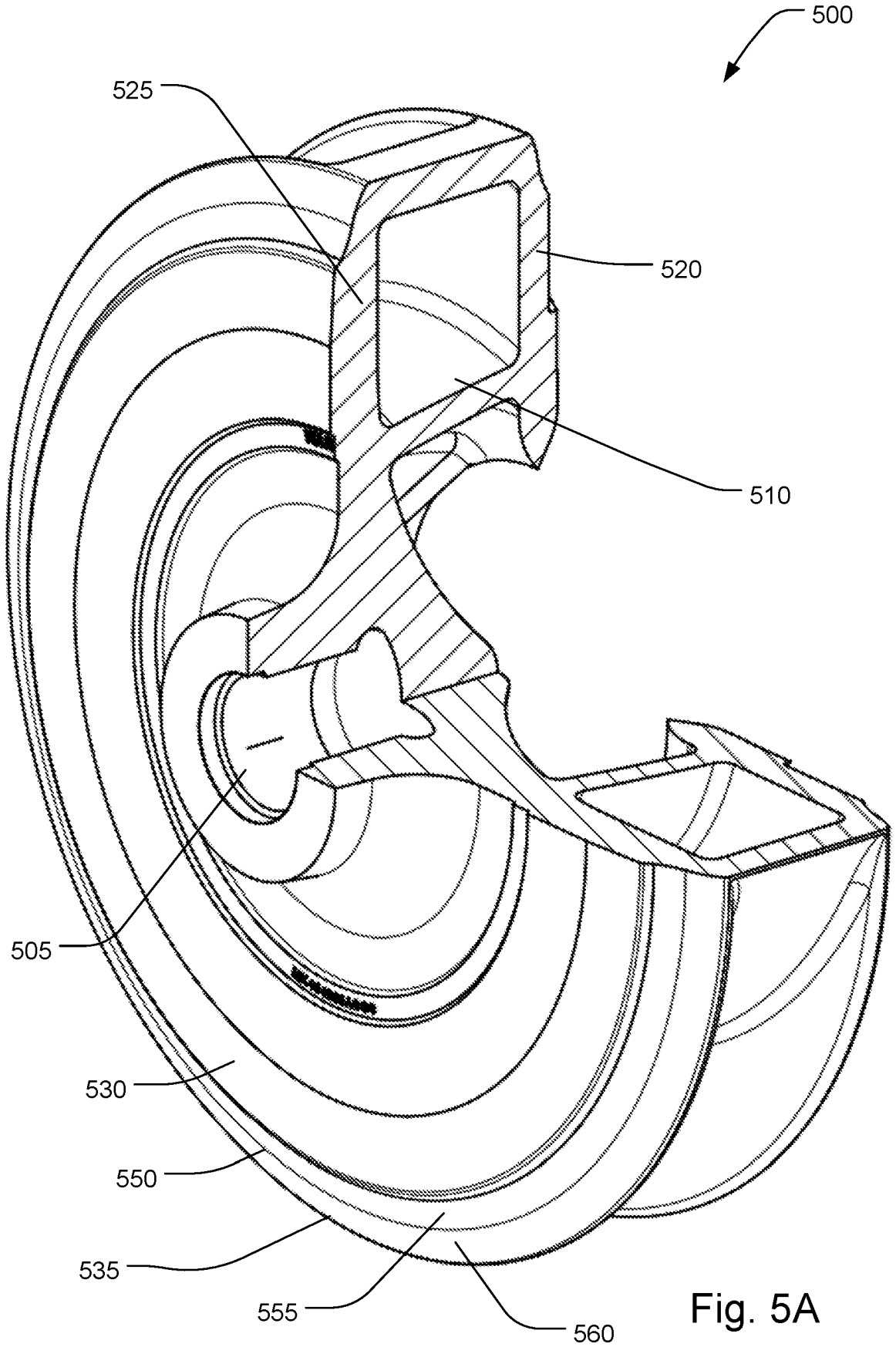
FIGS. 5A and 5B are isometric views, with a cut out, of an impeller that may be used in the centrifugal pump of FIG. 1.
Figure 5B:
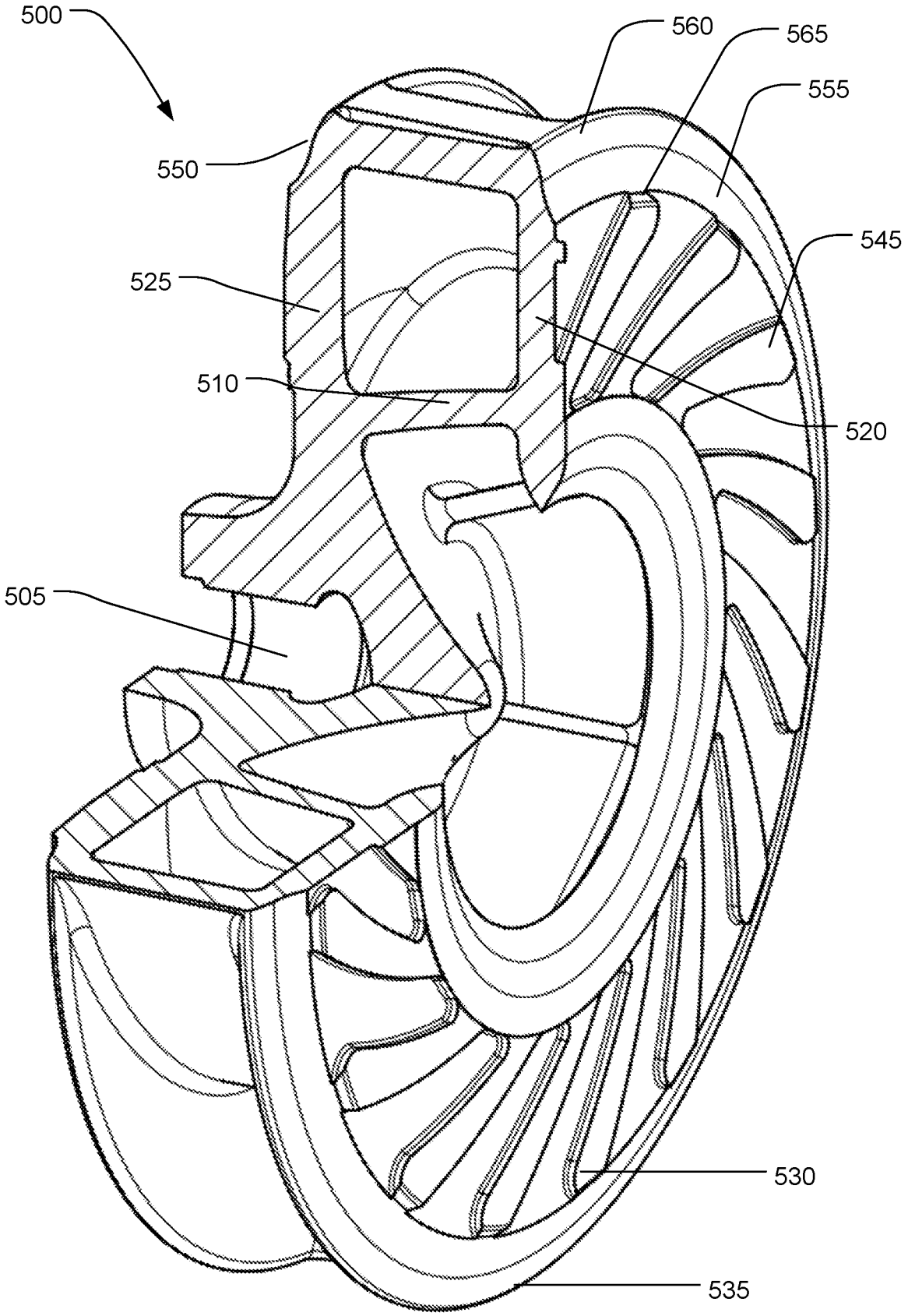

An impeller 500 will now be described in relation to FIGS. 5A and B. The impeller 500 is similar to the impeller 40 and the impeller 400 described above. The impeller 500 has a hub 505 for receiving a drive shaft. Circumferentially spaced pumping vanes 510 are located between a front shroud 520 and a back shroud 525. Located on the front shroud 520 are auxiliary vanes 545 that extend from a centre of the impeller 500 to tapered portion 550. The auxiliary vanes 545 are located on a planar portion 530, or substantially planar portion, of the front shroud 520. The back shroud 525 also has a planar portion 530, or substantially planar portion, located between the centre of the impeller 500 and the tapered portion 550. The tapered portion 550, extending to an outer edge 535 of the impeller 500 from the planar portion 530, has a concave region 555 and a convex region 560. As shown, the auxiliary vanes 545 are absent from the tapered portion 550. The concave region 555 is located towards the centre of the impeller 500 and the convex region 560 is located towards the outer edge of the impeller 500. As will be discussed below, the tapered portion 550 is a compound shape having the concave region 555 and the convex region 560. The auxiliary vanes 545 have a tapered portion of the auxiliary vanes 565 which transitions from the planar portion 530 to the tapered portion 550. In some embodiments the auxiliary vanes 545 may extend in to the tapered portion 550. The auxiliary vanes 545 may be tapered in a similar manner to the tapered portion 550.

Figure 6:
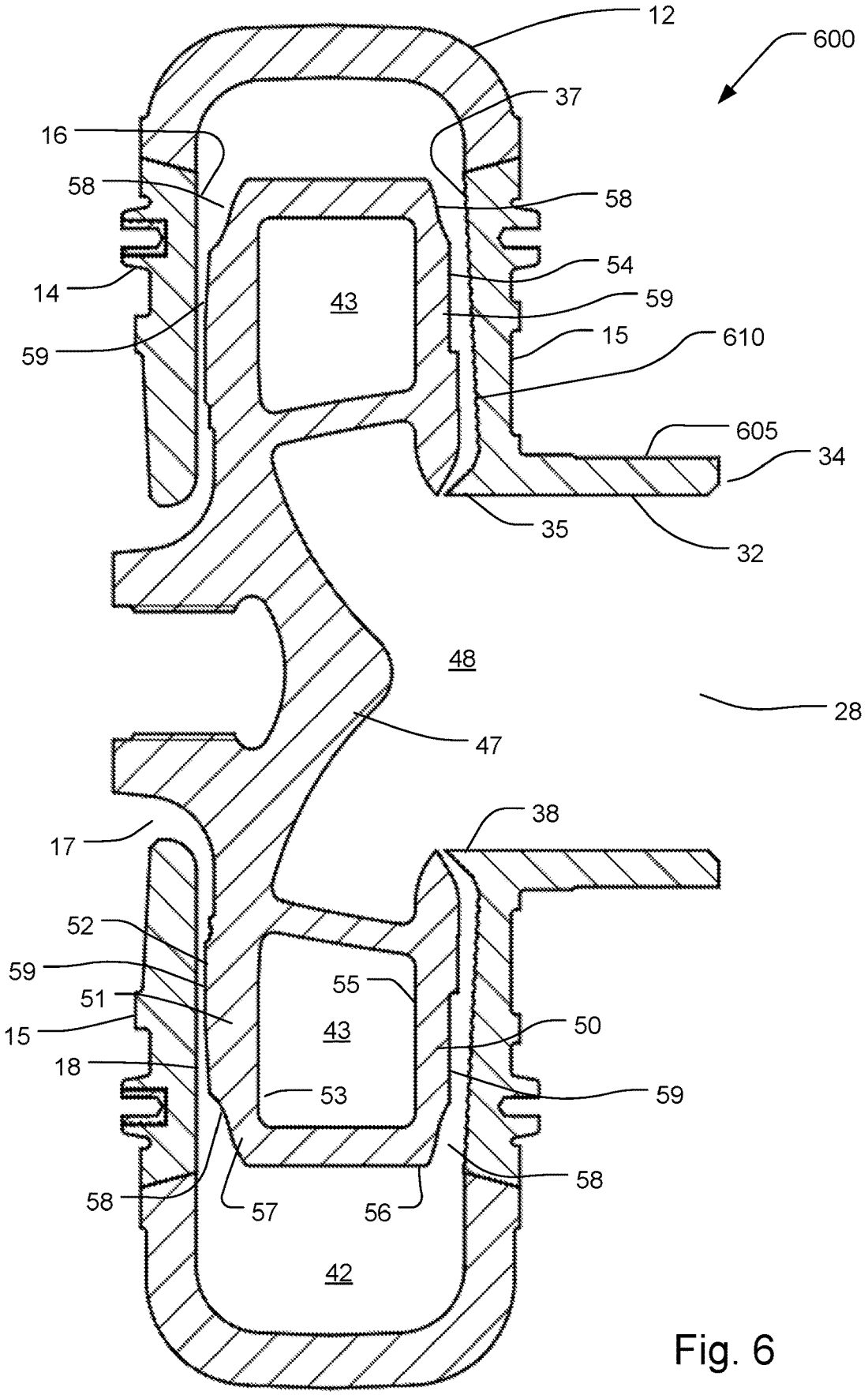
FIG. 6 is across-sectional view of another form of centrifugal pump apparatus according to one embodiment.

FIG. 6 shows a pump 600, similar to the pump 10 of FIGS. 1 and 2. The pump 600 has many of the same features as the pump 10 and the same features are marked with the same reference numerals as used for the pump 10. However, the pump 600 has a different style of side liner with a grooved front side liner 605. The front side liner 605 has grooves 610 cut in to the surface 37 that is in contact with the material or fluid pumped by the pump 600. The grooves 610 may reduce a rate of wear of the front side liner 605. When used in conjunction with the shroud tapers 58 of the impeller 40, the grooves 610 in the front side liner 605 may combine to further reduce a rate of wear of the front side liner 605 when compared to a flat surfaced side liner. A grooved side liner, also referred to as a patterned side liner, such as the grooved front side liner 605, will be described in more detail in relation to FIG. 8

Figure 7A:
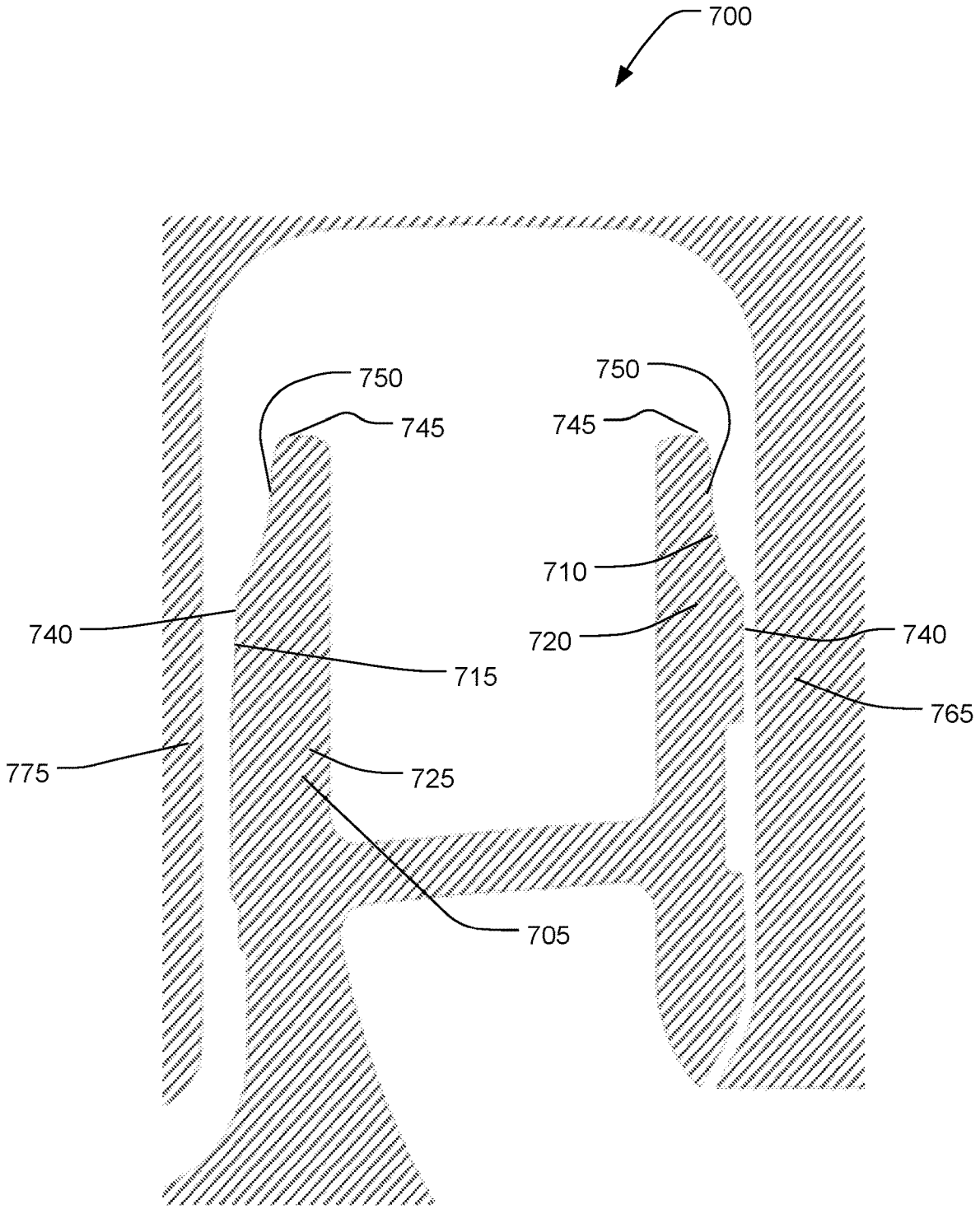
FIGS. 7A and 7B are cross-sectional views of a portion of a centrifugal pump apparatus according to one embodiment.
Figure 7B:
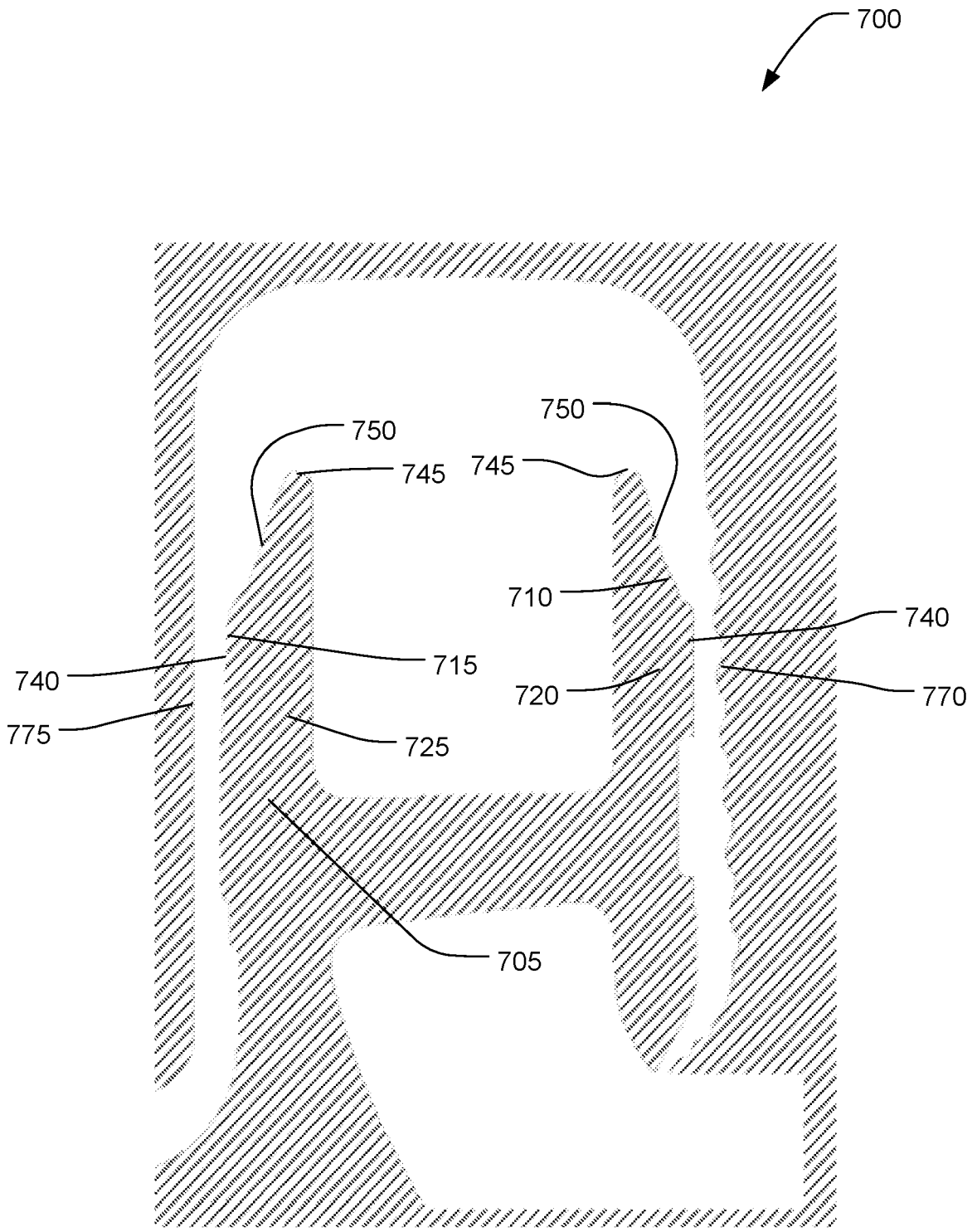

FIGS. 7A and B show a cross section of a portion of a pump 700 with an impeller 705. The impeller 705 has a front shroud 720 and a back shroud 725. Each of the shrouds have a tapered portion 750 located near an outer edge 745 of the shrouds with a planar portion 740 located between the tapered portion 750 and a centre of the impeller 705. The tapered portions 750 are located on an outer surface 710 of the front shroud 720 and an outer surface 715 of the back shroud 725. FIG. 7A has a smooth front side liner 765 and a smooth back side liner 775. FIG. 7B shows the pump 700 using the smooth back side liner 775 and a patterned front side liner 770. The patterned front side liner 770 may be a grooved side liner, such as will be described in relation to FIG. 8 or have other patterns on the liner.

A side liner will now be described in relation to FIG. 8 which shows a patterned side liner 800, more specifically a back side liner having a radially swirling pattern for use in a centrifugal pump such as pump 10. While the side liner 800 is described as a back side liner, a patterned side liner may also be used for the front side liner. As discussed above, the radially swirling pattern on the side liner 800 may reduce localised wear on the side liner, compared to a flat surfaced side liner. The decreased wear may increase an operational lifespan of the patterned side liner. Typically, a side liner such as the side liner 800 is a replaceable part in a centrifugal pump made out of a suitable material such as rubber, elastomer or metal. The side liner 800 operates in a manner similar to the side liner 14 of FIG. 1.

The side liner 800 has a centrally located aperture 810. The aperture 810 allows passage of a shaft into a pumping chamber of a centrifugal pump to rotate an impeller, such as the impeller 40 or the impeller 400 described above. The side liner 800 has a surface 815 that is placed facing towards the pumping chamber and may be in contact with slurry pumped by the centrifugal pump. The surface 815 has an inner edge 820, forming an edge of the aperture 810 and seals with the drive shaft, such as the drive shaft described above. An outer edge 830 of the surface 815 may form a seal with a main liner, such as main liner 12 described above.

Located on the surface 815 are a plurality of grooves 840. The grooves 840 are formed into the surface 815 and may extend radially from the inner edge 820 to the outer edge 830, as shown in FIG. 8. The grooves 840 may be considered to be in a plane parallel to the surface 815. Depth of the grooves 840 may vary over the surface 815. One example of a depth profile for the grooves 840 is for the grooves 840 to be shallower closer the inner edge 820 and the outer edge 830. With such a depth profile a deepest part of the grooves 840 may be located at, or near, a mid-region 850 located between the inner edge 820 and the outer edge 830. The depth profile of the grooves 840 may vary.

Figure 8:
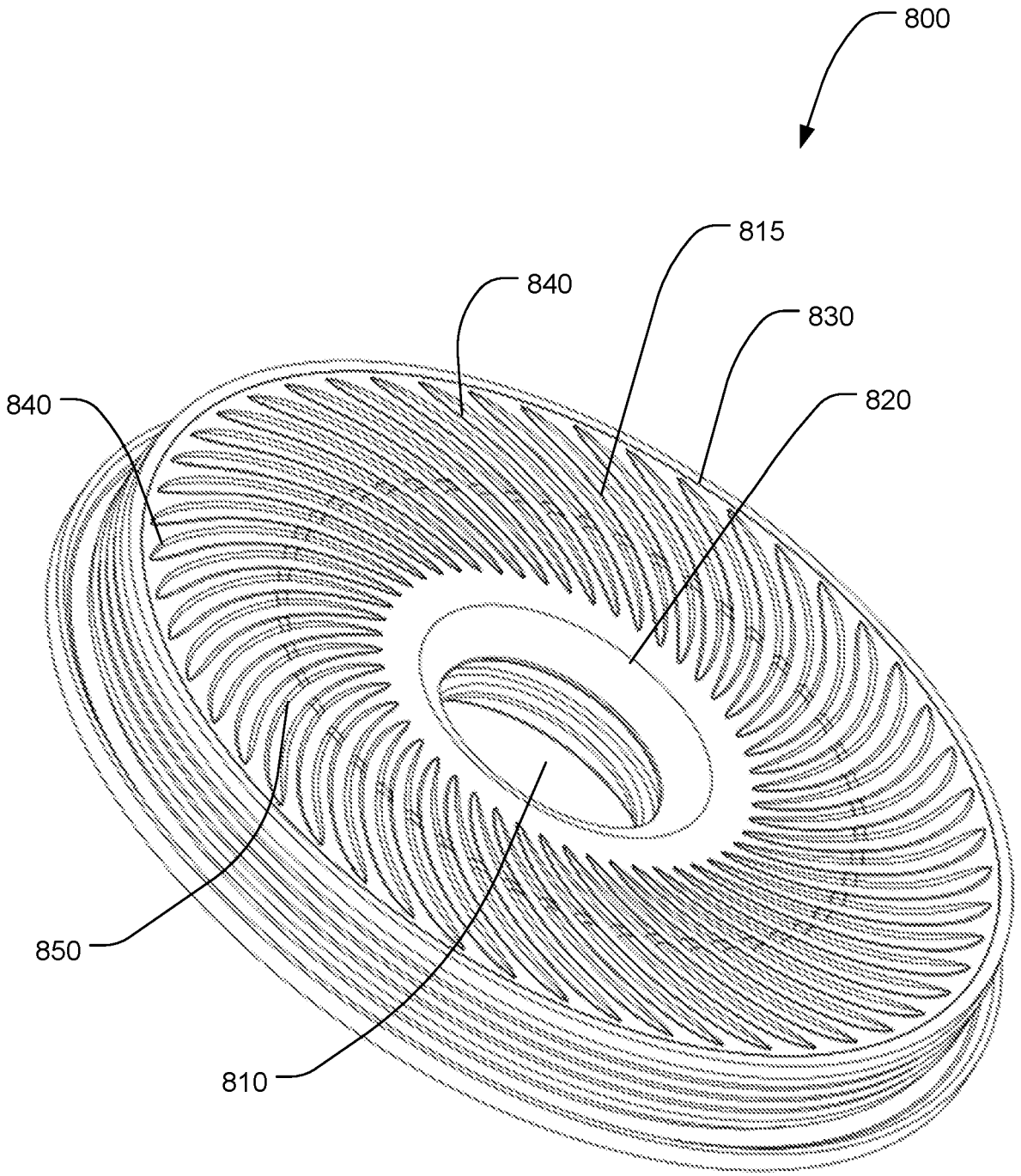
FIG. 8 illustrates a side liner with grooves according to one embodiment.

The grooves 840 of FIG. 8 are not straight lines, but are arced or curved. The direction of curvature of the arc may play a role in reducing gouging of the side liner 800. The grooves 840 are formed in an arc with curvature in a direction opposite to a direction of curvature of the main pumping vanes of the impeller of the centrifugal pump. The curvature of the grooves 840 is also in a direction opposite to curvature of the auxiliary vanes of the impeller, if auxiliary vanes are fitted. As a result, the direction of the curvature will differ between the front and the back side liners, when looking at the grooved surface of the liners. The front and side liners have grooves that may be referred to as forwards-curving grooves when viewed with a direction of rotation of the impeller, as compared to the backward-curving vanes of the impeller.

Figure 9A:
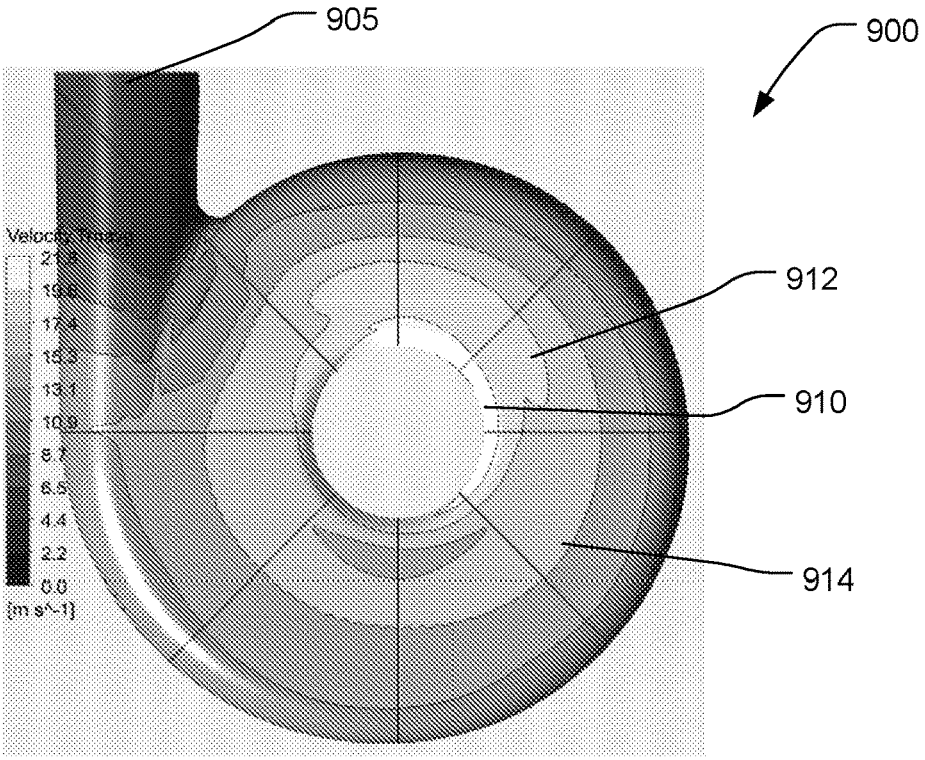
FIGS. 9A to D illustrate slurry velocity on pump liners according to at least one embodiment.
Figure 9B:
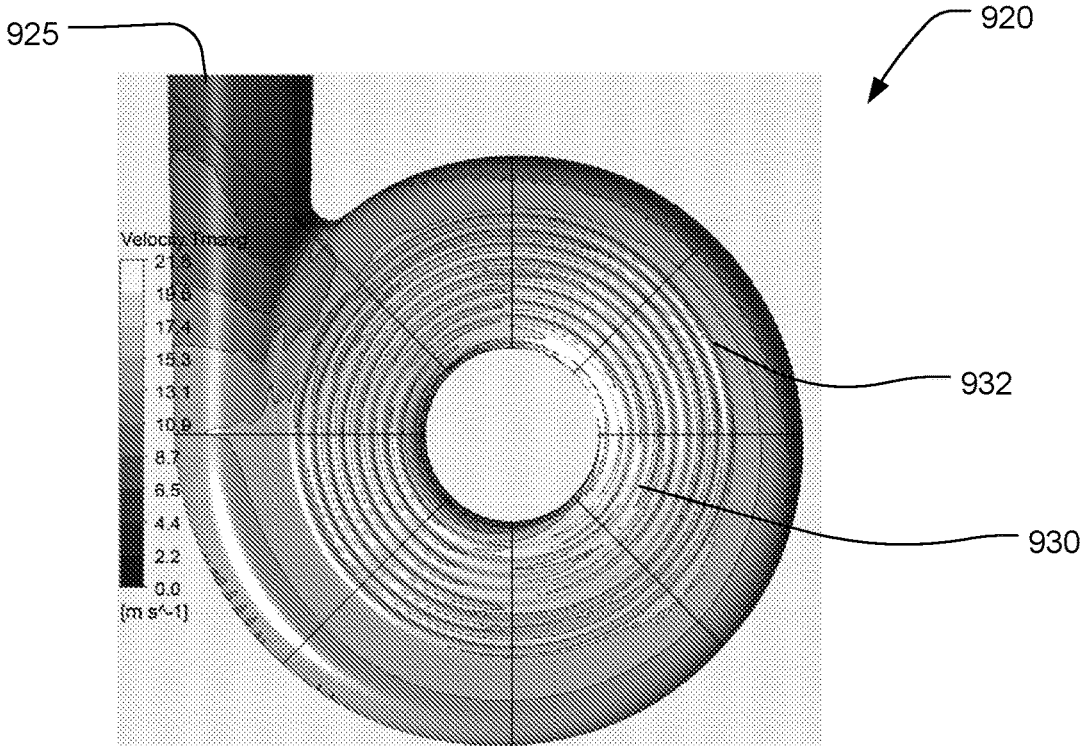

FIGS. 9A to D show simulation results for a speed of a material, such as a slurry, flowing over a pump liner when operating with an impeller having tapered portions and auxiliary vanes only on a front shroud, such as the impeller 500. FIG. 9A shows a pump liner 900 with a flat front side liner. Pumped material exits the pump liner 900 via an outlet 905. A high velocity region 910 is located at a centre of the pump liner 900, transitioning to a medium velocity region 912 before the material velocity drops to a low velocity region 914. FIG. 9B show material velocities in a pump liner 920 when a grooved front side liner is used, with an outlet 925. The grooved front liner dissipates more of the material velocities when compared to the pump liner 900 with a flat front side liner. A medium velocity region 930 is located near a centre of the pump liner 920, with material velocity dropping to a low velocity region 932 away from the pump centre.

Figure 9C:
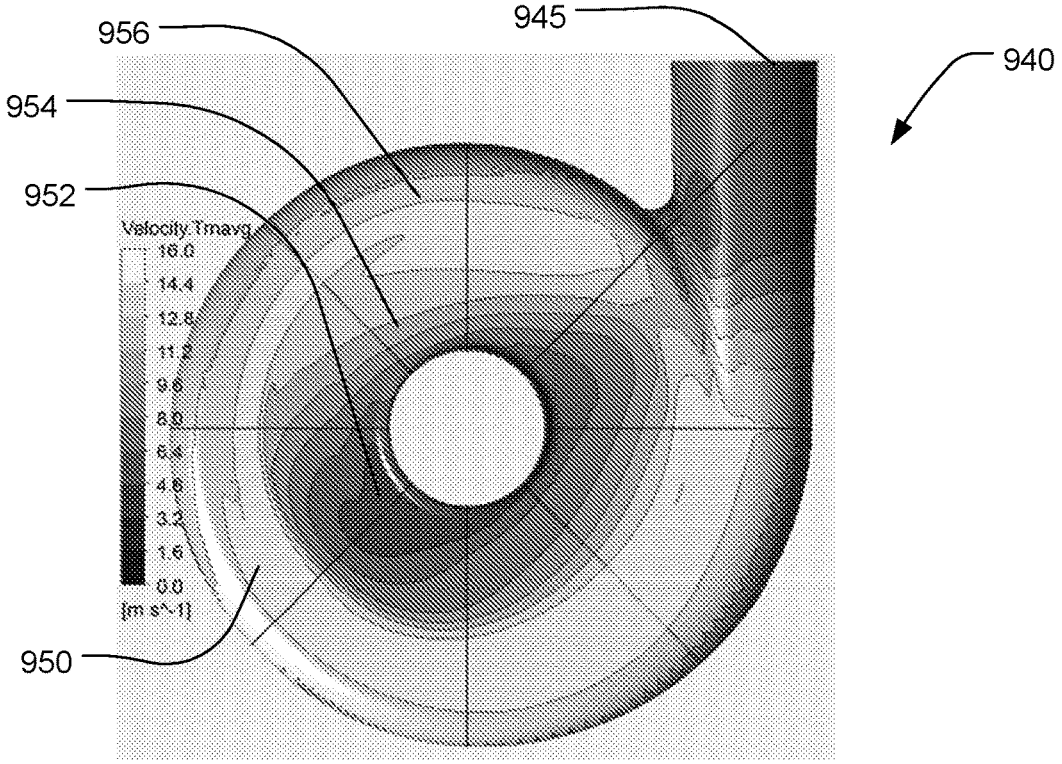
Figure 9D:
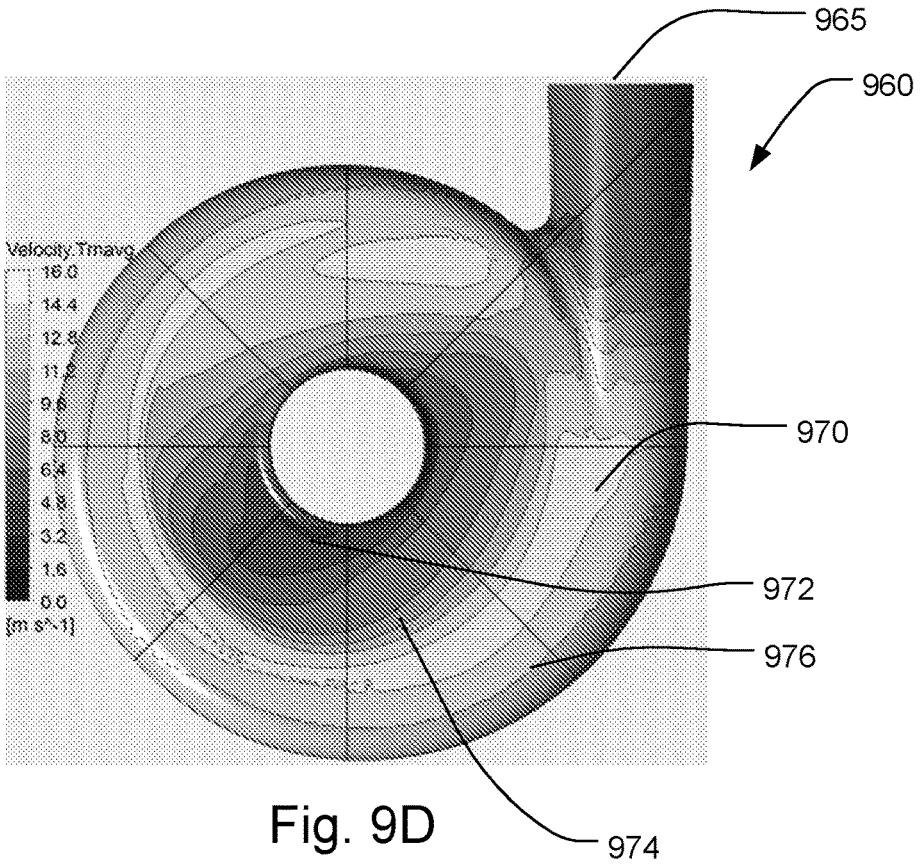

FIGS. 9C and D show an opposite side of the pump liner 900 and the pump liner 920, respectively. FIG. 9C shows a pump liner 940, including a back side liner, including an outlet 945. The pump liner 940 uses a flat front side liner, not shown in FIG. 9C. A very low velocity region 952 is located towards a centre of pump liner 940. The material velocity increases to a low velocity region 954 and then a medium velocity region 950. Outside of the medium velocity region 950 is a low velocity region 956. FIG. 9D shows a pump liner 960 with an outlet 965. FIG. 9D shows flat back side liner. The pump liner 960 has a grooved front side liner, not shown. The pump liner 960 has a very low velocity region 972 located near a centre of the pump liner 960. The very low velocity region 972 transitions to a low velocity region 974, then a medium velocity region 970. The outer edge of the liner has a low velocity region 976. The medium velocity region 970 is smaller than the comparable medium velocity region 950 of the pump liner 940.

Figure 10A:
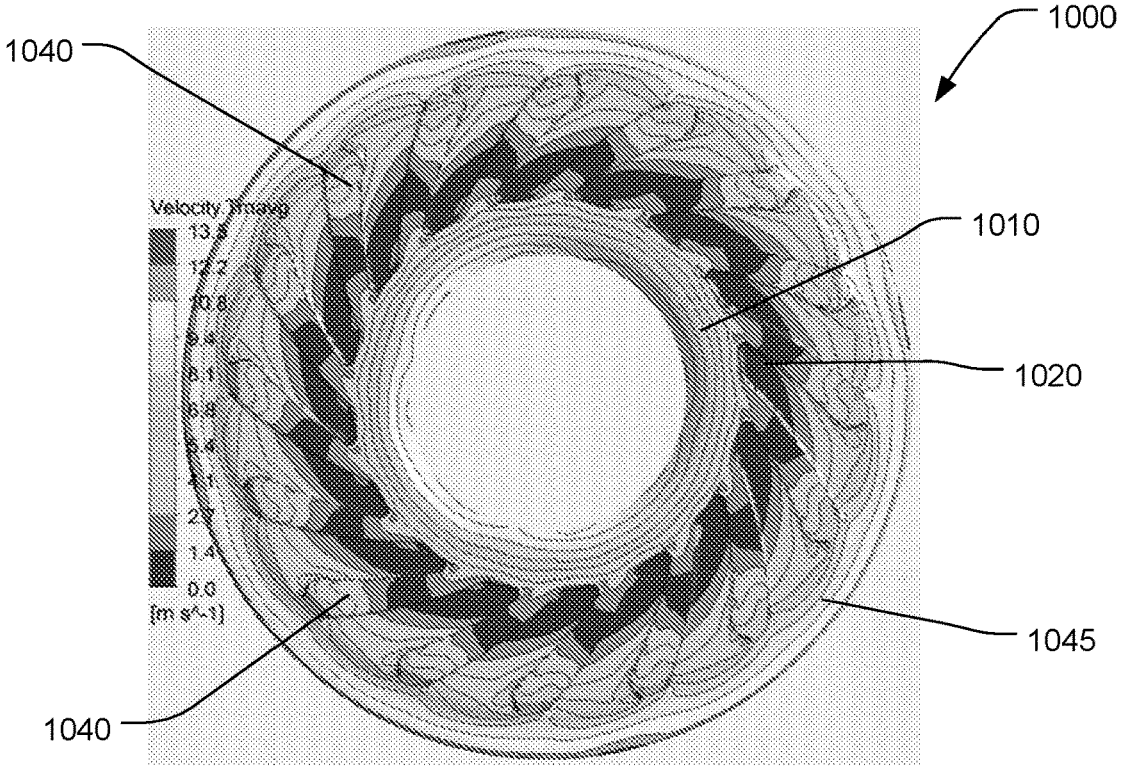
FIGS. 10A and B illustrate slurry velocity on pump liners according to at least one embodiment.

Simulation results for a speed of a material, such as a slurry, flowing over an impeller, operating inside a pump, will now be described in relation to FIGS. 10A and B. The figures show a front shroud of an impeller, such as the impeller 500. Located on the front shroud are auxiliary vanes. FIG. 10A shows an impeller 1000 modelled in a pump liner with a flat front side liner. The impeller 1000 has auxiliary vanes 1040 on an outer face of a shroud of the impeller 1000. The impeller 1000 has a low velocity region 1010 located near a centre of the impeller 1000. A very low velocity region 1020 extends across most of the area covered by the auxiliary vanes 1040. A low velocity region 1030 is located near an outer edge of the impeller 1000, where a tapered portion 1045 is located.

Figure 10B:
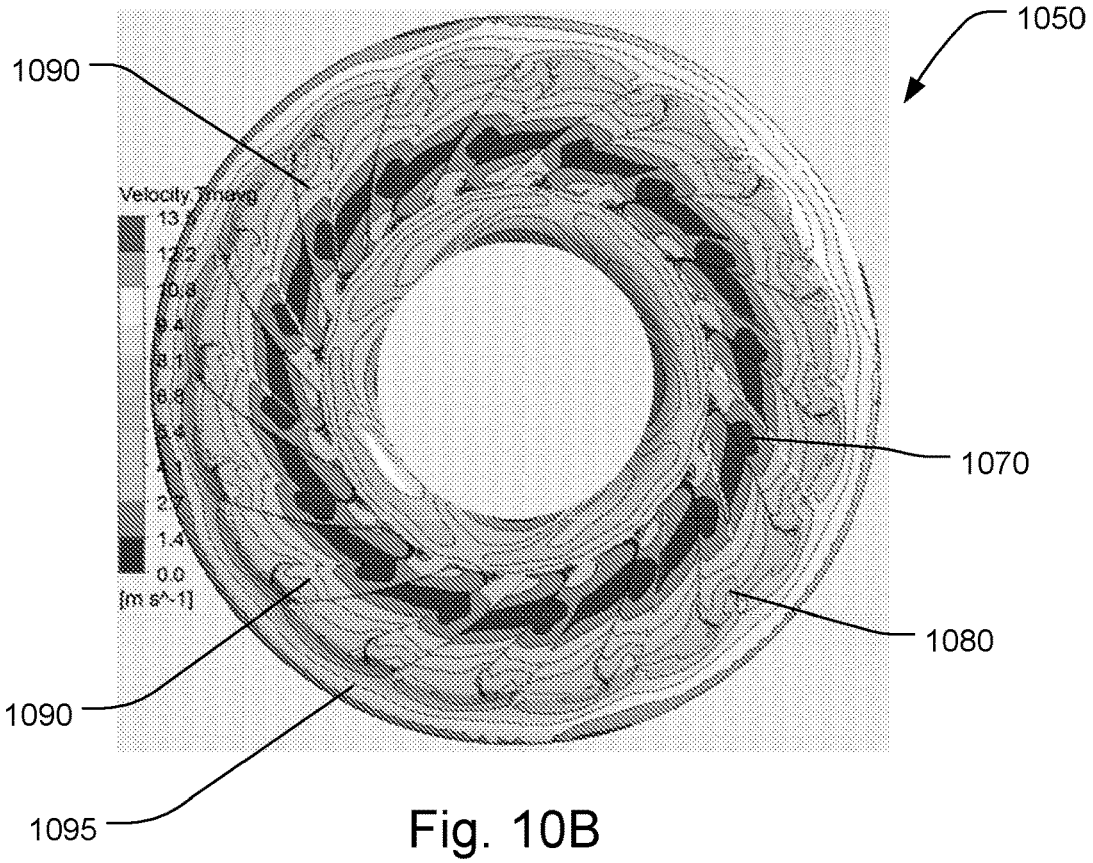

FIG. 10B shows an impeller 1050 modelled in a pump liner with a grooved front side liner. The impeller 1050 has auxiliary vanes 1090 on an outer face of a shroud of the impeller 1050. The impeller 1050 has a low velocity region 1060 located near a centre of the impeller 1050. A very low velocity region 1070 extends across most of the area covered by the auxiliary vanes 1090. A low velocity region 1080 is located near an outer edge of the impeller 1050, where a tapered portion 1095 is located. The low velocity region 1060 of the impeller 1050 is lower than the low velocity region 1010 of the impeller 1000.

Figure 11A:
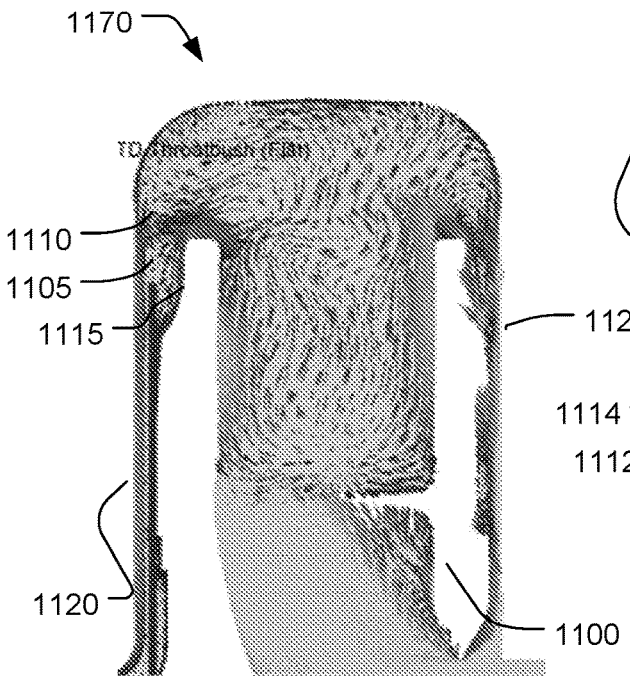
FIGS. 11A to D illustrate slurry velocity in a pumping chamber according to at least one embodiment.

FIGS. 11A to D show projected fluid velocities inside a pump using an impeller with a tapered portion. FIG. 11A shows a pumping chamber 1170 with an impeller 1100. A flat back side liner 1120 and a flat front side liner 1125 are located on either side of the impeller 1100. The impeller 1100 has tapered portions 1115 on an outer surface of the impeller 1100. There is a lower velocity region 1105 of fluid near the tapered portion 1115 and a higher velocity region 1110 located near an outer edge of the impeller 1100. An advantage of an impeller with a tapered portion is that a higher velocity region, such as the higher velocity region 1110 is located further away from a side liner. The result may be that fluid velocity near an outer edge of an impeller may have greater dissipation before reaching the side liner compared to an impeller without a tapered portion. As a result, one or both of the side liners may wear slower when an impeller has a tapered portion, compared to an impeller without a tapered portion.

Figure 11B:
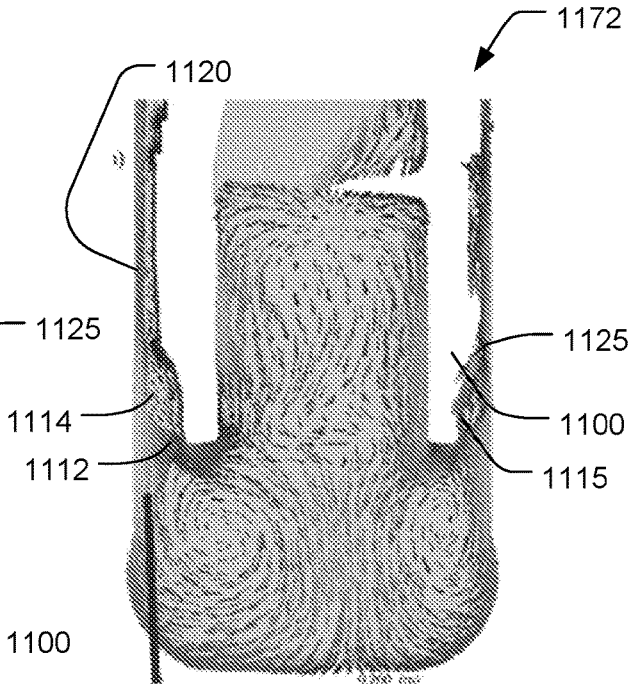

FIG. 11B shows a lower portion of pumping chamber 1172 with the impeller 1100 with the flat front side liner 1125 and the flat back side liner 1120. The motion of the impeller 1100 in the pumping chamber 1172 creates a higher velocity region 1112 near an outer edge of the impeller 1100 and a lower velocity region 1114 between the tapered portion 1115 and the back side liner 1120. Similar regions are present around the other shroud of the impeller 1100.

Figure 11C:
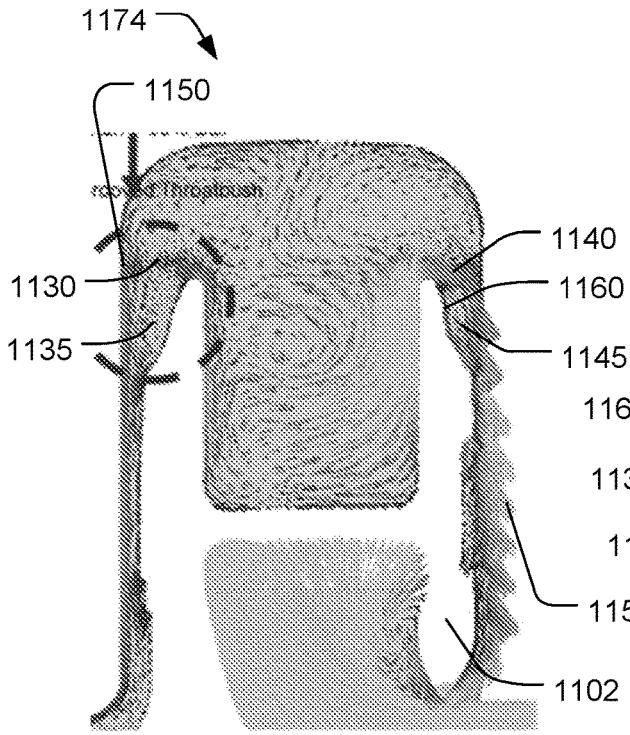
Figure 11D:
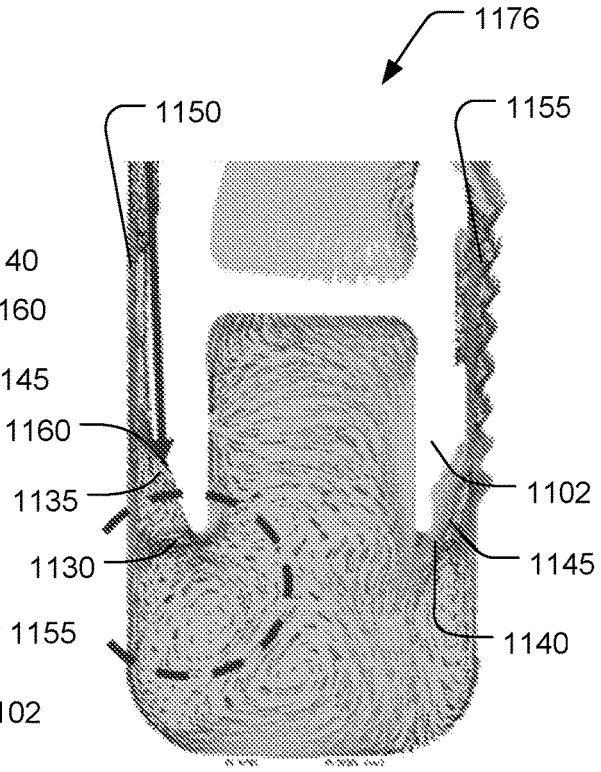

FIG. 11C shows an upper portion of a pumping chamber 1174 with a flat back side liner 1150, a grooved front side liner 1155 and an impeller 1102. The impeller 1102 has a tapered portion 1160. A higher velocity region 1130 is located near an outer edge of the impeller 1102 and a lower velocity region 1135 is located between the tapered portion 1160 and the flat back side liner 1150. Similarly, a higher velocity region 1140 and a lower velocity region 1145 are located on a front shroud of the impeller 1102. FIG. 11D shows a pumping chamber 1176 with the flat back side liner 1150, the grooved front side liner 1155 and the impeller 1102. The impeller 1102 generates the higher velocity region 1130 and the lower velocity region 1135 for the back shroud in the pumping chamber 1176 as well as the higher velocity region 1140 and the lower velocity region 1145 for the front shroud. As with the impeller 1100, the tapered portions 1160 of the impeller 1102 may result in slow wear of side liners when compared to an impeller without tapered portions for the reason described above.

Figure 12A:
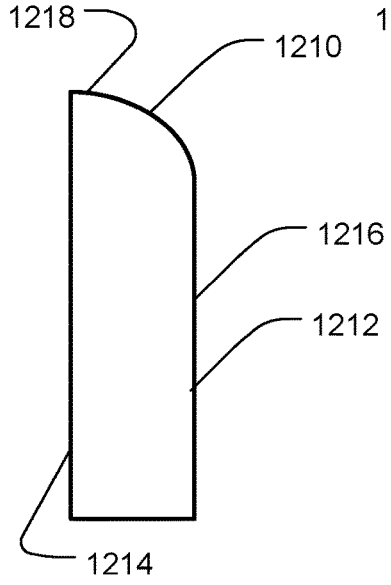
FIGS. 12A to F illustrate tapered portion profiles for a shroud of an impeller according to at least one embodiment.
Figure 12B:
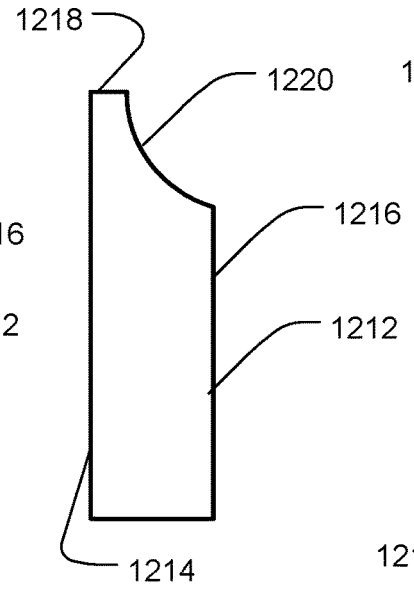
Figure 12C:
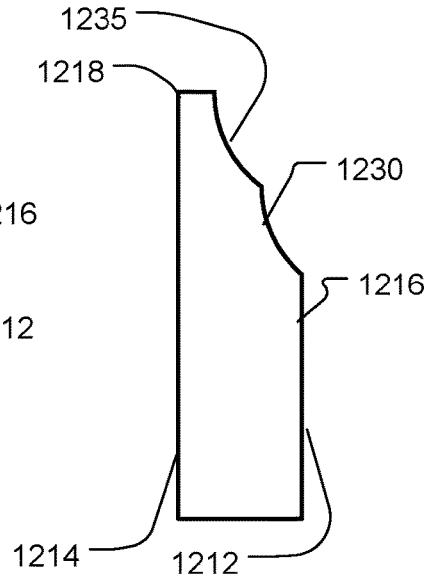

FIGS. 12A to F show possible profiles for the tapered portion of an impeller shroud. Each of the FIGS. 12A to F show a section of an impeller shroud with an outer face 1212 and an inner face 1214. Each of the outer faces of the impeller shrouds have a planar portion 1216 leading to the tapered portion on the outer face of the shroud. The tapered portion is located at, or leads to, an outer edge 1218 of the impeller. FIG. 12A shows a convex taper portion 1210 at an outer edge of the shroud. FIG. 12B shows a concave taper portion 1220. FIG. 12C shows a tapered portion with two concave sections, an inner concave region 1230 and an outer concave region 1235, where inner is located closer to a centre of the impeller and outer refers to a location closer to the outer edge 1218. The tapered portion of FIG. 12C may be considered to be a compound shape made up of two simpler shapes, in this case two concave regions.

Figure 12D:
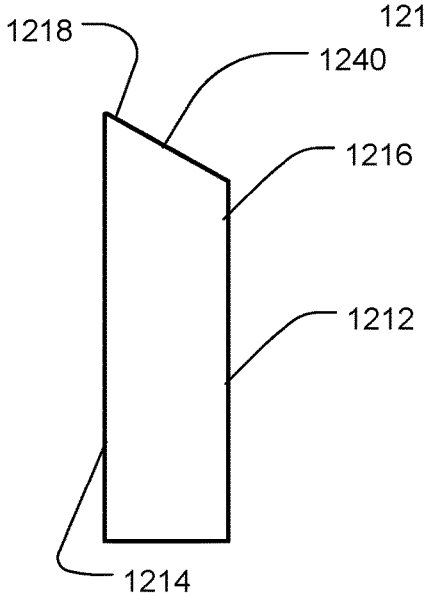
Figure 12E:
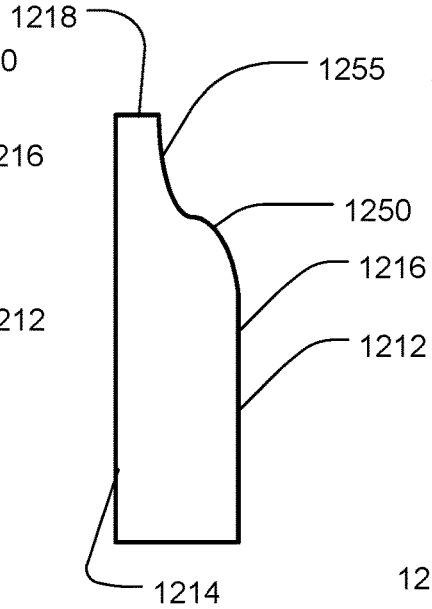
Figure 12F:
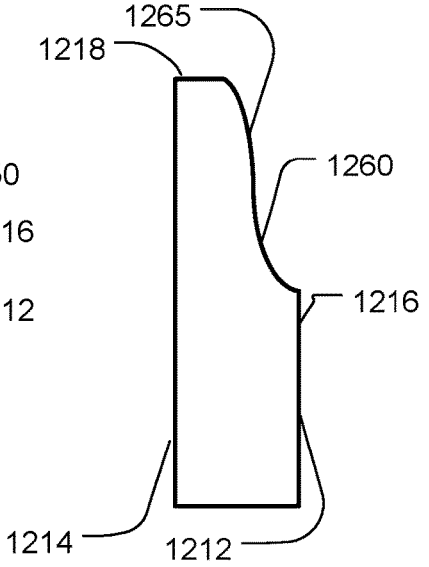

FIG. 12D shows a straight taper portion 1240. While the straight taper portion 1240 forms a point with the inner face 1214 at the outer edge 1218, variations may have the straight taper portion 1240 ending further away from the inner face 1214 to a flat region on the outer edge 1218 of the impeller shroud. Such an arrangement may provide a stronger outer edge 1218 design than a straight taper that extends across the thickness of the shroud. FIG. 12E shows a tapered portion with a compound shape made of an inner convex region 1250 and an outer concave region 1255. FIG. 12F shows a tapered portion with an opposite profile to FIG. 12E with an inner concave region 1260 and an outer convex region 1265. The outer convex region 1265 is located closer to the outer edge than the inner concave region 1260. In one embodiment, the taper may be based on an 85% trim, or thickness reduction, based on standard thickness of the shroud versus the taper. It may also be that the inner concave region 1260 and the outer convex region 1265 have an equal radius. The size of the radius may be determined based on the size of the impeller with the radius increasing as the size of the impeller increases. The tapered portion profiles shown in FIGS. 12A to F are some examples that may be used on the shroud of an impeller. Other profiles may also be used including other compound shapes. For example, the tapered portion may have an inner straight region and an outer concave portion. Alternatively, the tapered portion may have an inner convex region and an outer convex region.

Some impellers may have a taper on one or more shrouds that extends along the shroud. For example, where the thickness of the shroud decreases from a centre, near the impeller inlet, along the planar portion of the shroud. Such impellers have a planar portion that may be tapered from being thicker closer to the centre of the impeller to thinner near the outer edge. The planar portion has a variable thickness and is thinner near the outer edge than near the centre of the impeller. In such an example, the tapered portion is an additional taper where a rate of thickness reduction is higher than the planar portion. That is, the rate of change of the shroud thickness may increase for the tapered portion, compared to other regions of the shroud. For some impellers, a reduction in thickness of the tapered portion is greater than a reduction thickness in the planar portion. For some impellers the tapered portion of the shroud has a thickness variation greater than for regions of the shroud outside the tapered portion.

The tapered portion is also located closer to the outer edge of the impeller when compared to the planar portion. That is, the planar portion is located closer to a centre of the impeller than the tapered portion. The planar portion may be located directly adjacent to the tapered portion, or there may be another section between the planar portion and the tapered portion. The planar portion may be flat or may be substantially planar.

The tapered portion may be used only on the front shroud of the impeller, only on the back shroud of the impeller, or on both the front and back shrouds of the impeller. Although the pumps described above have a flat back side liner, a grooved or patterned back side liner may be also be used in addition to a grooved or patterned back side liner. Alternatively, the back side liner may be grooved or patterned, and the front side liner may be flat.

The side liner 800 described above has arced grooves, other designs are also possible. For example, the grooves may extend radially or have arcs curving in an opposite direction. Alternatively, the side liners may have overlapping grooves, such as a cross hatched pattern. Further, the shaped of the grooves or patterns of the back and the front liner may be different.

As described above, one advantage of an impeller with one or more tapered portions is that wear of the side liners may be slower than for an impeller without tapered portions. Wear of the main liner may also be slow for pumps using impellers one or more tapered portions. While some of the pumps described above used patterned side liners, the patterned side liners are not required to gain an advantage when using an impeller with a tapered portion. However, using one or more patterned side liners may provide an additional benefit in reducing a rate of wear of the liners of the pump.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The invention claimed is:

1. An impeller for a centrifugal slurry pump, the impeller comprising:

an inlet through which fluid passes into the impeller;

pumping vanes for pumping the fluid from the inlet and expelling the fluid into a pumping chamber of the centrifugal pump in which the impeller operates; and at least one shroud extending radially from an axis of rotation for the impeller and attached to the pumping vanes, the at least one shroud having an outer surface facing away from the pumping vanes, wherein the at least one shroud includes a planar portion and a tapering portion associated with the outer surface of the at least one shroud, the planar portion located near a centre of the impeller and the tapering portion located at an outer edge of the at least one shroud so that the respective shroud tapers continuously from the planar portion to the outer edge, each tapering portion being a compound shape with contiguous concave and convex regions.

2. The impeller of claim 1, wherein the at least one shroud has auxiliary vanes having a tapered portion that extends to the tapering portion of the respective shroud.

3. The impeller of claim 1, wherein the concave region of the at least one shroud extends from the planar portion with the convex region extending from the concave region towards the outer edge.

4. The impeller of claim 1, wherein a thickness of the at least one shroud at the outer edge is at most 75% of a thickness of the at least one shroud at the planar portion.

5. The impeller of claim 1, wherein a radial length of the planar portion of the last one shroud is larger than a radial length of the tapering portion.

6. The impeller of claim 1, wherein a thickness of the at least one shroud at the outer edge is at most 50% of the at least one shroud at the planar portion.

7. A centrifugal slurry pump having an impeller according to claim 1.

* * * * *